US007755460B2

(12) United States Patent
Nguyen et al.

(10) Patent No.: US 7,755,460 B2
(45) Date of Patent: Jul. 13, 2010

(54) MICRO-SWITCHING DEVICE

(75) Inventors: Anh Tuan Nguyen, Ho Chi Minh (VN); Tadashi Nakatani, Kawasaki (JP); Satoshi Ueda, Kawasaki (JP); Yu Yonezawa, Yokohama (JP); Naoyuki Mishima, Yokohama (JP)

(73) Assignee: Fujitsu Limited, Kawasaki (JP)

( * ) Notice: Subject to any disclaimer, the term of this patent is extended or adjusted under 35 U.S.C. 154(b) by 447 days.

(21) Appl. No.: 11/987,884

(22) Filed: Dec. 5, 2007

(65) Prior Publication Data

US 2008/0142348 A1 Jun. 19, 2008

(30) Foreign Application Priority Data

Dec. 7, 2006 (JP) ..... 2006-330974

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS

| | | | | |
|---|---|---|---|---|
| 6,229,683 | B1 * | 5/2001 | Goodwin-Johansson | 361/233 |
| 6,734,770 | B2 * | 5/2004 | Aigner et al. | 335/78 |
| 6,750,742 | B2 * | 6/2004 | Kang et al. | 333/262 |
| 6,875,936 | B1 | 4/2005 | Suzuki et al. | |
| 7,122,942 | B2 * | 10/2006 | Song et al. | 310/328 |
| 7,312,677 | B2 | 12/2007 | Nakatani et al. | 335/78 |
| 7,362,199 | B2 * | 4/2008 | Chou et al. | 335/78 |
| 7,405,641 | B1 * | 7/2008 | Hsu et al. | 335/78 |
| 2003/0183887 | A1 | 10/2003 | Lee et al. | |
| 2003/0227361 | A1 | 12/2003 | Dickens et al. | |
| 2004/0173872 | A1 | 9/2004 | Park et al. | |
| 2005/0225921 | A1 | 10/2005 | Nakatani et al. | |
| 2006/0208612 | A1 | 9/2006 | Takayama et al. | |
| 2007/0115081 | A1 * | 5/2007 | Kim et al. | 333/262 |
| 2007/0116406 | A1 * | 5/2007 | Yonezawa et al. | 385/18 |
| 2008/0210531 | A1 * | 9/2008 | Nakatani et al. | 200/181 |

FOREIGN PATENT DOCUMENTS

| | | |
|---|---|---|
| JP | 2000-348595 | 12/2000 |
| JP | 2004-1186 | 1/2004 |
| JP | 2004-311394 | 11/2004 |
| JP | 2005-528751 | 9/2005 |
| JP | 2005-293918 | 10/2005 |
| JP | 2005-302711 | 10/2005 |
| KR | 10-2005-0087703 | 8/2005 |

* cited by examiner

*Primary Examiner*—Elvin G Enad
*Assistant Examiner*—Bernard Rojas
(74) *Attorney, Agent, or Firm*—Kratz, Quintos & Hanson, LLP

(57) ABSTRACT

A micro-switching device includes a movable electrode provided on a movable support having an end fixed to a fixing member. The switching device also includes first and second stationary electrodes. The movable electrode includes first and second contact portions. The first stationary electrode includes a third contact portion facing the first contact portion of the movable electrode. The second stationary electrode includes a fourth contact portion facing the second contact portion of the movable electrode. The distance between the first and the third contact portions is smaller than the distance between the second and the fourth contact portions. The switching device further includes a driving mechanism having a driving force generation region provided on the movable support. The center of gravity of the driving force generation region is closer to the second contact portion than to the first contact portion.

17 Claims, 23 Drawing Sheets

MICRO-SWITCHING DEVICE

BACKGROUND OF THE INVENTION

1. Field of the Invention

The present invention relates to micro-switching devices manufactured by means of MEMS technology.

2. Description of the Related Art

In the field of radio communications equipment such as mobile telephones, there has been an increasing demand for smaller radio frequency circuitry in order to meet e.g. increase in the number of parts which must be incorporated for higher performance. In response to such a demand, size reduction efforts are being made for a variety of parts necessary for constituting the circuitry, by using MEMS (micro-electromechanical systems) technology.

MEMS switches are examples of such parts. MEMS switches are switching devices in which each portion is formed by MEMS technology to have minute details, including e.g. at least one pair of contacts which opens and closes mechanically thereby providing a switching action, and a drive mechanism which works as an actuator for the mechanical open-close operations of the contact pair. In switching operations particularly for high-frequency signals in the Giga Hertz range, MEMS switches provide higher isolation when the switch is open and lower insertion loss when the switch is closed, than other switching devices provided by e.g. PIN diode and MESFET because of the mechanical separation achieved by the contact pair and smaller parasitic capacity as a benefit of mechanical switch. MEMS switches are disclosed in e.g. JP-A-2004-1186, JP-A-2004-311394, JP-A-2005-293918, and JP-A-2005-528751.

FIG. 21 through FIG. 25 show a conventional micro-switching device or a micro-switching device X4. FIG. 21 is a plan view of the micro-switching device X4, and FIG. 22 is a partial plan view of the micro-switching device X4. FIG. 23 through FIG. 25 are sectional views taken along lines XXIII-XXIII, XXIV-XXIV and XXV-XXV respectively in FIG. 21.

The micro-switching device X4 includes a base substrate S4, a fixing member 41, a movable part 42, a contact electrode 43, a pair of contact electrodes 44A, 44B (not illustrated in FIG. 22), a driver electrode 45, and a driver electrode 46 (not illustrated in FIG. 22).

As shown in FIG. 23 through FIG. 25, the fixing member 41 is bonded to the base substrate S4 via the boundary layer 47. The fixing member 41 and the base substrate S4 are formed of monocrystalline silicon whereas the boundary layer 47 is formed of silicon dioxide.

As shown in FIG. 22 and FIG. 25 for example, the movable part 42 has a stationary end 42*a* fixed to the fixing member 41, as well as a free end 42*b*. The movable part extends along the base substrate S4, and is surrounded by the fixing member 41 via a slit 48. The movable part 42 is formed of monocrystalline silicon.

As shown clearly in FIG. 22, the contact electrode 43 is near the free end 42*b* of the movable part 42. As shown in FIG. 23 and FIG. 25, each of the contact electrodes 44A, 44B is formed on the fixing member 41 and has a portion facing the contact electrode 43. Also, the contact electrodes 44A, 44B are connected with a predetermined circuit selected as an object of switching operation, via predetermined wiring (not illustrated). The contact electrodes 43, 44A, 44B are formed of a predetermined electrically conductive material.

As shown clearly in FIG. 22, the driver electrode 45 extends on the movable part 42 and over to the fixing member 41. As shown clearly in FIG. 24, the driver electrode 46 has its ends bonded to the fixing member 41 so as to bridge over the driver electrode 45. Also, the driver electrode 46 is grounded via predetermined wiring (not illustrated). The driver electrodes 45, 46 are formed of a predetermined electrically conductive material. The driver electrodes 45, 46 as described above serve as a drive mechanism in the micro-switching device X4, and has a driving force generation region R' on the movable part 42 as shown in FIG. 22. As shown clearly in FIG. 24, the driving force generation region R' is a region facing the driver electrode 46, in the driver electrode 45.

In the micro-switching device X4 arranged as described above, electrostatic attraction is generated between the driver electrodes 45, 46 when an electric potential is applied to the driver electrode 45. With the applied electric potential being sufficiently high, the movable part 42, which extends along the base substrate S4, is elastically deformed until the contact electrode 43 makes contact with the contact electrodes 44A, 44B, and thus a closed state of the micro-switching device X4 is achieved. In the closed state, the pair of contact electrodes 44A, 44B are electrically connected with each other by the contact electrode 43, to allow an electric current to pass through the contact electrodes 44A, 44B. In this way, it is possible to achieve an ON state of e.g. a high-frequency signal.

On the other hand, with the micro-switching device X4 assuming the closed state, if the application of the electric potential is removed from the driver electrode 45 whereby the electrostatic attraction acting between the driver electrodes 45, 46 is cancelled, the movable part 42 returns to its natural state, causing the contact electrode 43 to come off the contact electrodes 44A, 44B. In this way, an open state of the micro-switching device X4 as shown in FIG. 23 and FIG. 25 is achieved. In the open state, the pair of contact electrodes 44A, 44B are electrically separated from each other, preventing an electric current from passing through the contact electrodes 44A, 44B. In this way, it is possible to achieve an OFF state of e.g. a high-frequency signal.

In order to achieve the above-described closed state, the electric potential, i.e. driving voltage, to be applied to the driver electrode 45 in the micro-switching device X4 is often designed to be large, for the following reasons:

When the micro-switching device X4 is manufactured, the contact electrode 43 is formed by means of thin-film formation technology, on the movable part 42, or more accurately, at a predetermined place of formation where the movable part is to be formed on a material substrate. Specifically, the contact electrode 43 is formed by first forming a film of a predetermined electrically conductive material by spattering, vapor deposition, etc., on a predetermined surface, and then by patterning the film. The contact electrode 43 formed by thin-film formation technology usually has a certain amount of internal stress. As shown exaggeratingly in FIG. 26(*a*) and in FIG. 26(*b*) for example, the internal stress deforms a portion of the movable part 42 which is supposed to make contact with the contact electrode 43, as well as the region surrounding the portion, together with the contact electrode 43. Once such a deformation occurs, the distance between the two contact electrodes 43, 44A is often no longer equal to the distance between the contact electrodes 43, 44B, in a non-activated state i.e. the open state of the switch.

FIG. 27 shows an example process where the micro-switching device X4 changes its state from the open state to the closed state. FIG. 27(*a*) through FIG. 27(*c*) each include a partial enlarged section of the open/close point between the contact electrode 43 and the contact electrode 44A and a surrounding region, as well as a partial enlarged section of the open/close point between the contact electrode 43 and the contact electrode 44B and a surrounding region.

FIG. 27(*a*) shows an open state where the distance between the contact electrodes 43, 44A is smaller than the distance between the contact electrodes 43, 44B. If a voltage applied between the driver electrodes 45, 46 is gradually increased from 0 V, the electrostatic attraction between the driver electrodes 45, 46 also increases gradually, and because of this electrostatic attraction, the movable part 42 which extends along the base substrate S4 makes partial elastic deformation, and at a certain voltage $V_{11}$, the gap between the contact electrodes 43, 44A is closed as shown in FIG. 27(*b*). During such a process (the first process) from the open state shown in FIG. 27(*a*) through an intermediate state shown in FIG. 27(*b*), bending deformation occurs mainly in a portion of the movable part 42 ranging from a region corresponding to the driving force generation region R' shown in FIG. 22 to the stationary end 42*a*. The first process can also be described as follows: Namely, a force acts on the movable part 42 through a mechanism where the stationary end 42*a* of the movable part 42 functions as a fulcrum point or a fixed axis, with a working point of the force being the center of gravity C' of a portion (driving force generation region R') indicated in FIG. 22 as a region in the driver electrode 45 facing the driver electrode 46.

After the gap between the contact electrodes 43, 44A is closed as shown in FIG. 27(*b*), the voltage applied between the driver electrodes 45, 46 is increased further, to further increase the electrostatic attraction between the driver electrodes 45, 46. Then, at a certain voltage $V_{12}$ ($>V_{11}$), the gap between the contact electrodes 43, 44B is closed as shown in FIG. 27(*c*). In such a process (the second process) from the intermediate state shown in FIG. 27(*b*) through the closed state shown in FIG. 27(*c*), torsional deformation occurs mainly in the portion of the movable part 42 ranging from the region corresponding to the driving force generation region R' to the stationary end 42*a*. The second process can be described as follows: Namely, a force acts on movable part 42 through a mechanism shown in FIG. 22, where a virtual line F' which passes through the stationary end 42*a* of the movable part 42 and the point of contact provided by the contact electrodes 43, 44A represents a fixed axis or an axis of rotation, with a working point of the force being the center of gravity C' of the driving force generation region R'.

On the other hand, when the closed state is achieved in a micro-switching device X4 where the distance between the contact electrodes 43, 44A is larger than the distance between the contact electrodes 43, 44B in the open state, the gap between the contact electrodes 43, 44B is closed first and thereafter, the gap between the contact electrodes 43, 44A is closed.

In order to achieve a closed state in the micro-switching device X4, two processes are required for example as described above, i.e. the first process which is a process from the open state to the intermediate state in FIG. 27(*b*), and the second process which is a process from the intermediate state to the closed state shown in FIG. 27(*c*). The first process and the second process differ from each other in the mode of deformation of the movable part 42. In the deformation mode of the first process, the stationary end 42*a* of the movable part 42 acts as a fulcrum point or a fixed axis, and the distance between the fixed axis and the center of gravity C' of the driving force generation region R' (working point) is relatively long. For this reason, the first process requires a relatively small driving voltage $V_{11}$ or electrostatic attraction for an amount of momentum to be generated in e.g. the center of gravity C' in order to achieve a required level of deformation in the movable part 42. On the contrary, in the deformation mode of the second process, the virtual line F' which passes through the stationary end 42*a* of the movable part 42 and the point of contact provided by the contact electrodes 43, 44A represents a fixed axis or an axis of rotation, and the distance between the axis (virtual line F') and the center of gravity C' of the driving force generation region R' (working point) is substantially short. For this reason, in the deformation mode of the second process, a substantially large driving voltage $V_{12}$ must be applied between the driver electrodes 45, 46 whereby a substantially large amount of electrostatic attraction must be generated between the driver electrodes 45, 46 in order to generate a sufficient amount of momentum to deform the movable part 42 thereby closing the gap between the contact electrodes 43, 44B.

As has been described, in the conventional micro-switching device X4, the distance between the contact electrodes 43, 44A often differs from the distance between the contact electrodes 43, 44B, and in such a case, the distance between the virtual line F' (fixed axis) and the center of gravity C' (working point) in the driving force generation region R' in the second process is substantially short. Therefore, the micro-switching device X4 often requires a large voltage (driving voltage) in order to achieve the closed state where both of the contact electrodes 44A, 44B make contact with the contact electrode 43.

SUMMARY OF THE INVENTION

The present invention has been proposed under the above-described circumstances. It is therefore an object of the present invention to provide a micro-switching device suitable for reducing the driving voltage.

According to a first aspect of the present invention, there is provided a micro-switching device which comprises a fixing member, a movable part, a movable contact electrode, a first stationary contact electrode, a second stationary contact electrode and a drive mechanism. The fixing member is provided on a supporting substrate, for example. The movable part includes a first surface, a second surface opposite to the first surface, and a stationary end fixed to the fixing member. The movable part may extend in parallel to the supporting substrate. The movable contact electrode includes first and second contact portions provided on the first surface of the movable part and spaced from the stationary end in a predetermined offset direction, where the first contact portion and the second contact portion are spaced from each other in a direction intersecting the offset direction mentioned above. The first stationary contact electrode, bonded to the fixing member, includes a third contact portion facing the first contact portion of the movable contact electrode. The second stationary contact electrode, bonded to the fixing member, includes a fourth contact portion facing the second contact portion of the movable contact electrode. The drive mechanism, a source of driving force based on voltage application in accordance with a selected mode, includes a driving force generation region on the first surface of the movable part. When the switching device of the present invention is in a non-activated state or an open state, the distance between the first contact portion and the third contact portion (first distance) is smaller than the distance between the second contact portion and the fourth contact portion (second distance). In addition, the center of gravity of the driving force generation region is set to be closer to the second contact portion than to the first contact portion of the movable contact electrode.

In the micro-switching device having the above-described configuration, a closed state (switch-on state) is properly achieved by generating a large driving force at the driving force generation region of the drive mechanism, and deforming the movable part so that the movable contact electrode makes contact with both the first stationary contact electrode and the second stationary contact electrode. In the closed state, the pair of stationary contact electrodes are electrically connected with each other by the movable contact electrode, to allow an electric current to pass through the stationary contact electrodes. The above-described arrangement "the first distance is smaller than the second distance in the non-activated or the open state" is suitable for causing the first contact portion to come into contact with the stationary contact electrode earlier than the second contact portion when the closed state of the switching device is to be achieved.

The switching device of the present invention operates as follows. At an initial stage of the operation, the first contact portion of the movable contact electrode has come into contact with the third contact portion of the first stationary contact electrode, whereas the second contact portion of the movable contact electrode remains out of contact with the fourth contact portion of the second stationary contact electrode. In this state, when a sufficiently large driving force is generated in the switching device, a rotating force will act on the movable part at the center of the gravity of the driving force generation region, thereby causing the movable part to rotate about a virtual axis which passes through two points, i.e., a point on the stationary end of the movable part and another point at which the first contact portion and the third contact portion are contacted. According to the present invention, the center of gravity of the driving force generation region is closer to the second contact portion than to the first contact portion of the movable contact electrode. This configuration is advantageous to providing a long distance between the rotation axis and the center of gravity of the driving force generation region. As the distance between the rotation axis and the center of gravity of the driving force generation region is set to be greater, it becomes easier to generate a large rotation moment upon application of force to the center of gravity. Accordingly, it suffices to generate a relatively small driving force by the drive mechanism in order to deform the movable part for attaining the closed state, that is, bringing the movable contact electrode (second contact portion) and the second stationary contact electrode (fourth contact portion) into mutual contact. The generation of a small driving force only needs a low voltage to be applied to the driving mechanism for attaining the closed state.

The micro-switching device of the present invention is suitable for providing a long distance between the axis and the center of gravity (working point) of the driving force generation region when contact is made between the first contact portion of the movable contact electrode and the third contact portion of the first stationary contact electrode, but the second contact portion of the movable contact electrode has not made contact with the fourth contact portion of the second stationary contact electrode. Therefore, the device is suitable for reducing the driving voltage which need be applied to the drive mechanism in order to achieve the closed state.

In the first aspect of the present invention, the movable contact electrode may include a first projection and a second projection, where the first projection includes the first contact portion, and the second projection includes the second contact portion. In such an instance, the length of projection in the first projection may be equal to the length of projection in the second projection. More preferably, the length of projection in the first projection may be greater than the length of projection in the second projection. These arrangements are suitable for bringing the first contact portion of the movable contact electrode into contact with the third contact portion of the first stationary contact electrode before the second contact portion of the movable contact electrode is brought into contact with the fourth contact portion of the second stationary contact electrode during the process of achieving the closed state of the device.

Preferably, the first stationary contact electrode may include a third projection, and the third projection may include the third contact portion. Likewise, the second stationary contact electrode may include a fourth projection, and the fourth projection may include the fourth contact portion. In this case, the length of projection in the third projection may be equal to the length of projection in the fourth projection. More preferably, the length of projection in the third projection may be greater than the length of projection in the fourth projection. These arrangements are suitable for bringing the first contact portion of the movable contact electrode into contact with the third contact portion of the first stationary contact electrode before bringing the second contact portion of the movable contact electrode into contact with the fourth contact portion of the second stationary contact electrode, in the process of achieving the closed state in the present switching device.

In a preferred embodiment, the distance between the first contact portion of the movable contact electrode and the third contact portion of the first stationary contact electrode may be zero in an non-activated state (open state) of the present switching device. To this end, the first contact portion and the third contact portion may be integrally connected to each other. These arrangements are suitable for reducing discrepancies in orientation of the movable contact electrode on the movable part with respect to the two stationary contact electrodes, under the non-activated state of the switching device. The reduction in discrepancies is advantageous in reducing the driving voltage.

Preferably, the distance between the stationary end of the movable part and the first contact portion of the movable contact electrode differs from the distance between the stationary end and the second contact portion. For example, the distance between the stationary end and the second contact portion may be smaller than the distance between the stationary end and the first contact portion. The movable part may have a nonlinear structure as a whole. Preferably, the center of gravity of the driving force generation region is offset from a virtual line which passes through a bisecting point of the length of the stationary end and a bisecting point of the distance between the first contact portion and the second contact portion, toward the region in which the second contact portion exists. These arrangements are suitable in providing a long distance between the axis of rotation and the center of gravity of the driving force generation region on the movable part.

A second aspect of the present invention provides a micro-switching device which includes a fixing member, a movable part, a movable contact electrode, a first stationary contact electrode, a second stationary contact electrode and a drive mechanism. The fixing member is a part fixed to e.g. a supporting substrate. The movable part includes a first surface, a second surface opposite to the first surface, and a stationary end fixed to the fixing member. The movable contact electrode, provided on the first surface of the movable part at a distance from the stationary end, includes a contact portion and a bonding portion spaced from the stationary end in a predetermined offset direction, where the contact portion and the bonding portion are spaced from each other in a direction intersecting the offset direction mentioned above. The first stationary contact electrode includes a bonded portion bonded to the bonding portion of the movable contact electrode, and is bonded to the fixing member. The second stationary contact electrode includes a portion which faces the contact portion of the movable contact electrode, and is bonded to the fixing member. The drive mechanism, which generates a driving force when a voltage is applied in accordance with a predetermined mode, includes a driving force generation region on the first surface of the movable part. The center of gravity of the driving force generation region is closer to the contact portion than to the bonded portion of the movable contact electrode.

According to the micro-switching device which has the configuration described above, it is possible to achieve a closed state (switch-on state) by generating a driving force in the driving force generation region of the drive mechanism, to a sufficient level to deform the movable part so that the contact portion of the movable contact electrode makes contact with the second stationary contact electrode. In the closed state, the pair of stationary contact electrodes are electrically connected with each other by the movable contact electrode, to allow an electric current to pass through the stationary contact electrodes.

The above-described driving force is generated in the switching device of the present invention under a state where the bonded portion of the movable contact electrode is bonded to the first stationary contact electrode, but the contact portion is not in contact with the second stationary contact electrode. In this situation, the driving force acts on the movable part through a mechanism where a virtual line that passes through a point of bonding provided by the bonded portion and the first stationary contact electrode and the stationary end of the movable part represents an axis of rotation, with a working point of the force being the center of gravity of the driving force generation region. The above-described arrangement that the center of gravity of the driving force generation region in the drive mechanism is closer to the contact portion than to the bonded portion of the movable contact electrode is suitable in providing a long distance between the axis and the center of gravity (working point) of the driving force generation region. As the distance between the axis and the center of gravity (working point) in the driving force generation region becomes longer, it is easier to generate a large momentum at the center of gravity of the driving force generation region in the deformation process of the movable part before the gap between the movable contact electrode and the second stationary contact electrode is closed, with a smaller minimum driving force being required for generation by the drive mechanism in order to achieve the closed state. And, the smaller the minimum driving force is, the smaller is a minimum voltage which must be applied in order to achieve the closed state.

Hence, the present micro-switching device, which is suitable for providing a long distance between the fixed axis (virtual line) and the center of gravity (working point) of the driving force generation region under a situation where the bonded portion of the movable contact electrode is bonded to the first stationary contact electrode, but the contact portion of the movable contact electrode has not made contact with the second stationary contact electrode, is suitable for reducing the driving voltage which must be applied to the drive mechanism in order to achieve the closed state.

In the second aspect of the present invention, preferably, the distance between the stationary end of the movable part and the bonded portion of the movable contact electrode may differ from the distance between the stationary end of the movable part and the contact portion. The movable part may have a nonlinear structure. Preferably, the center of gravity of the driving force generation region is on a side of the second contact portion with respect to a virtual line passing through a bisecting point of the length of the stationary end and a bisecting point of the distance between the contact portion and the bonded portion. These arrangements, which relate to the shape of the movable part and the movable contact electrode on the movable part, are suitable in having a long distance between the above-described fixed axis or the axis of rotation and the center of gravity (working point) of the driving force generation region on the movable part.

In a preferred embodiment according to the first and the second aspects of the present invention, the drive mechanism includes a movable driver electrode provided on the first surface of the movable part, and a stationary driver electrode having a portion facing the movable driver electrode and bonded to the fixing member. The micro-switching device according to the present invention is preferably be driven electrostatically.

In another preferred embodiment according to the first and the second aspects of the present invention, the drive mechanism includes a laminated structure provided by a first electrode film on the first surface of the movable part, a second electrode film and a piezoelectric film between the first and the second electrode films. The micro-switching device according to the present invention may be driven piezoelectrically.

In another preferred embodiment according to the first and the second aspects of the present invention, the drive mechanism includes a laminated structure provided by a plurality of materials of different thermal expansion ratios. The micro-switching device according to the present invention may also be driven thermally.

DETAILED DESCRIPTION OF THE PREFERRED EMBODIMENTS

Figure 1:
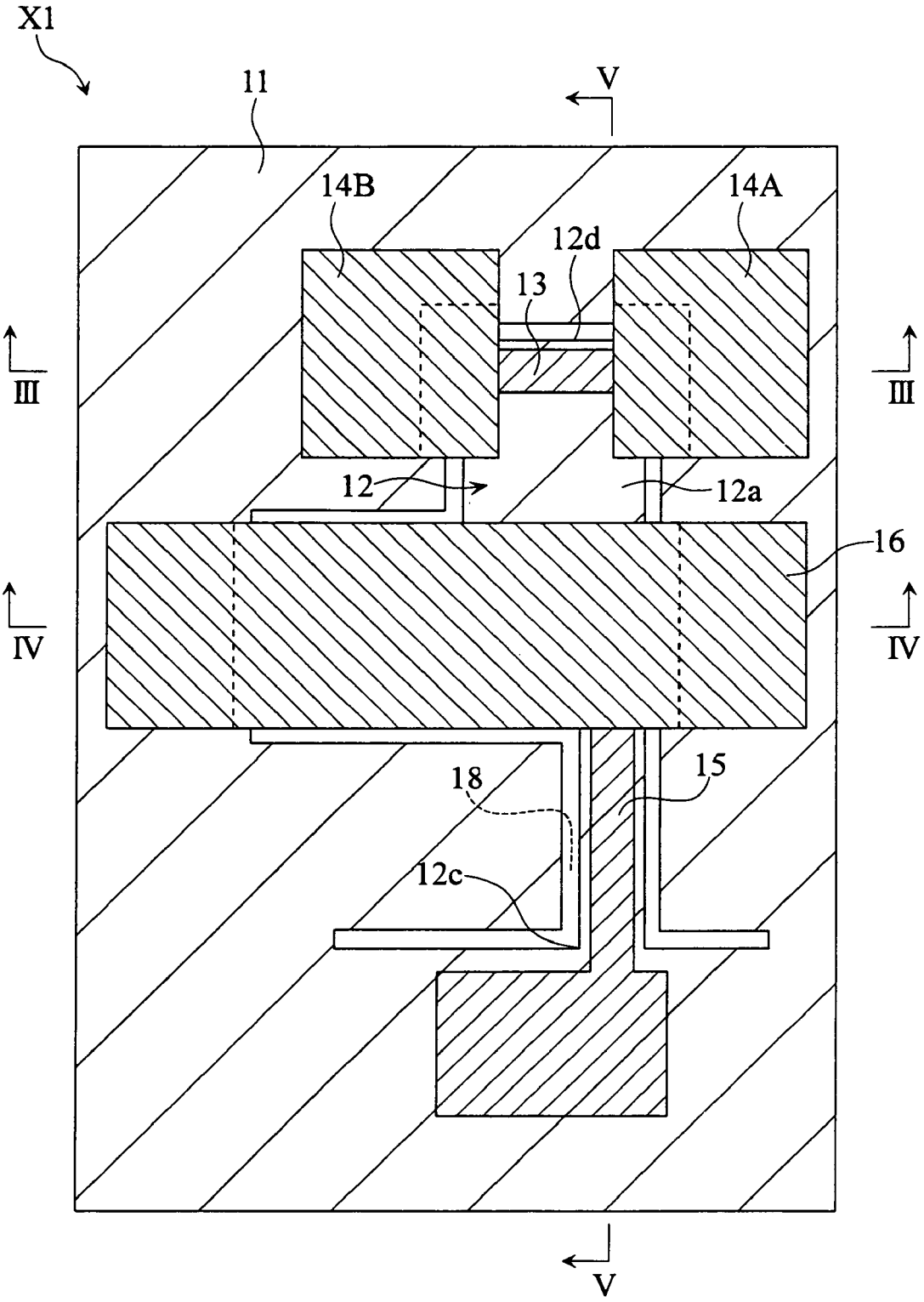
FIG. 1 is a plan view of a micro-switching device according to a first embodiment of the present invention.
Figure 2:
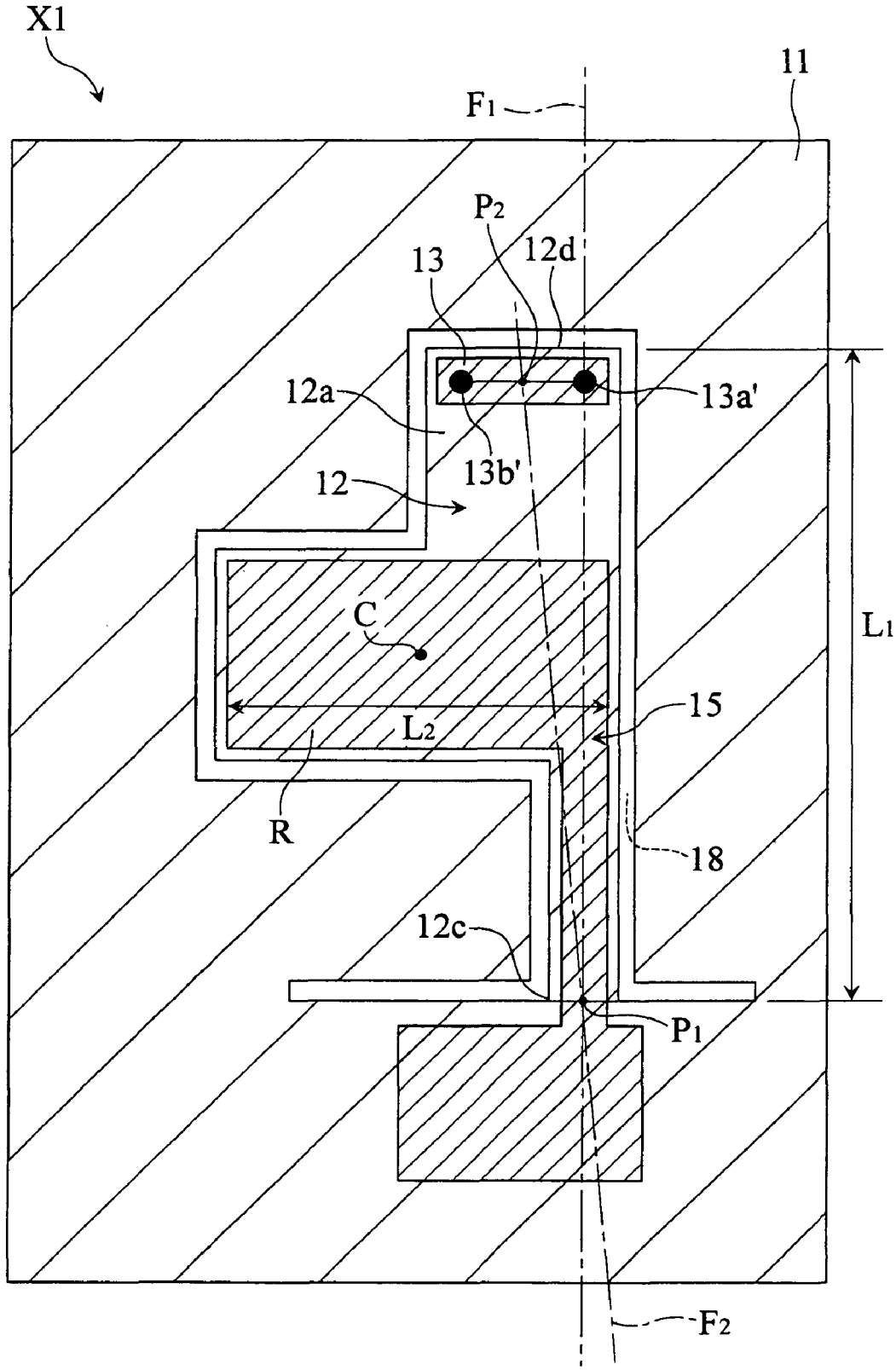
FIG. 2 is a plan view of the micro-switching device in FIG. 1, with some parts omitted.
Figure 3:
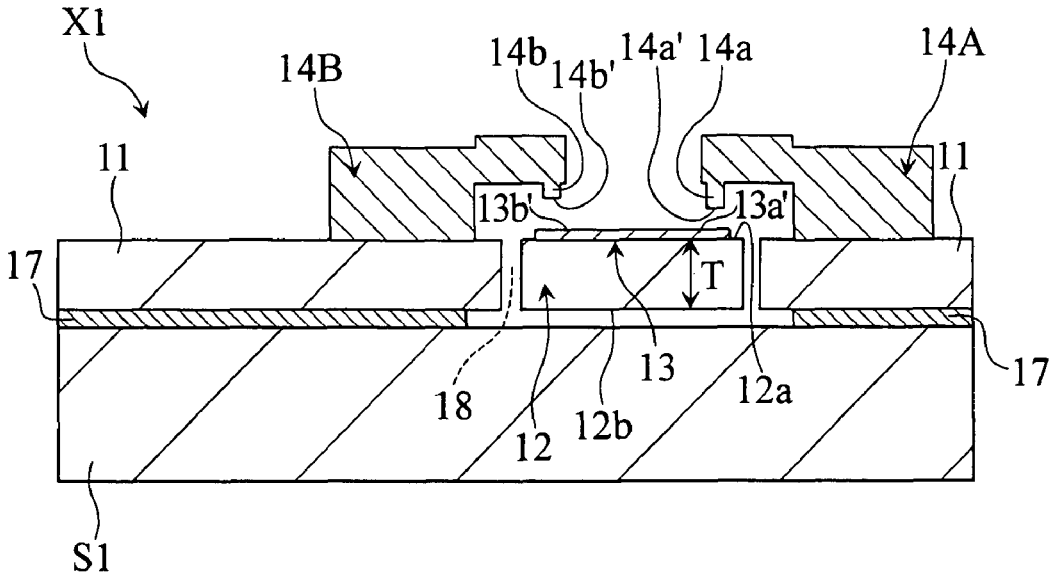
FIG. 3 is a sectional view taken along lines III-III in FIG. 1.
Figure 4:
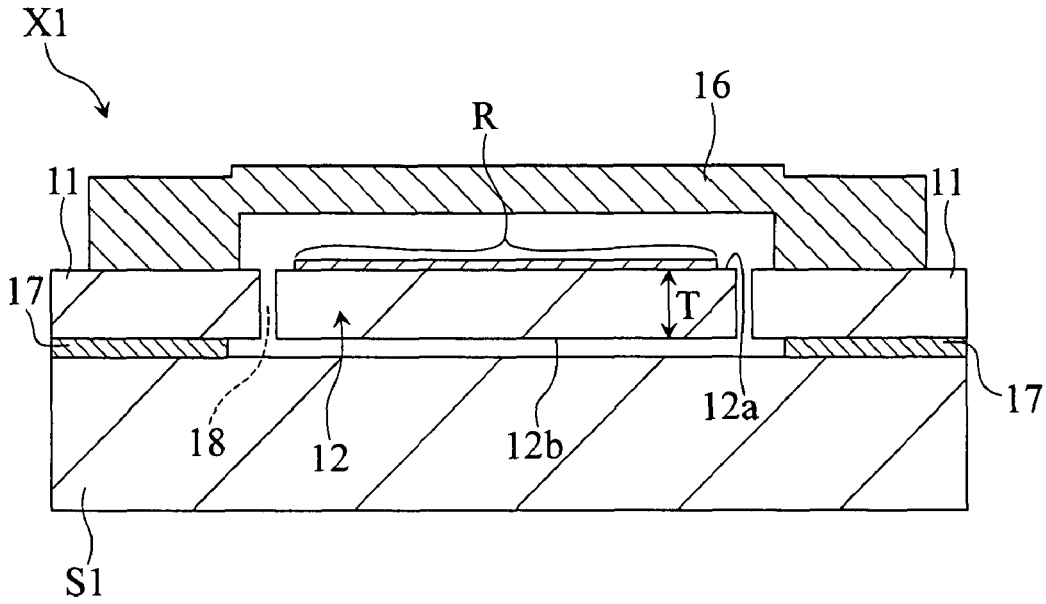
FIG. 4 is a sectional view taken along lines IV-IV in FIG. 1.
Figure 5:
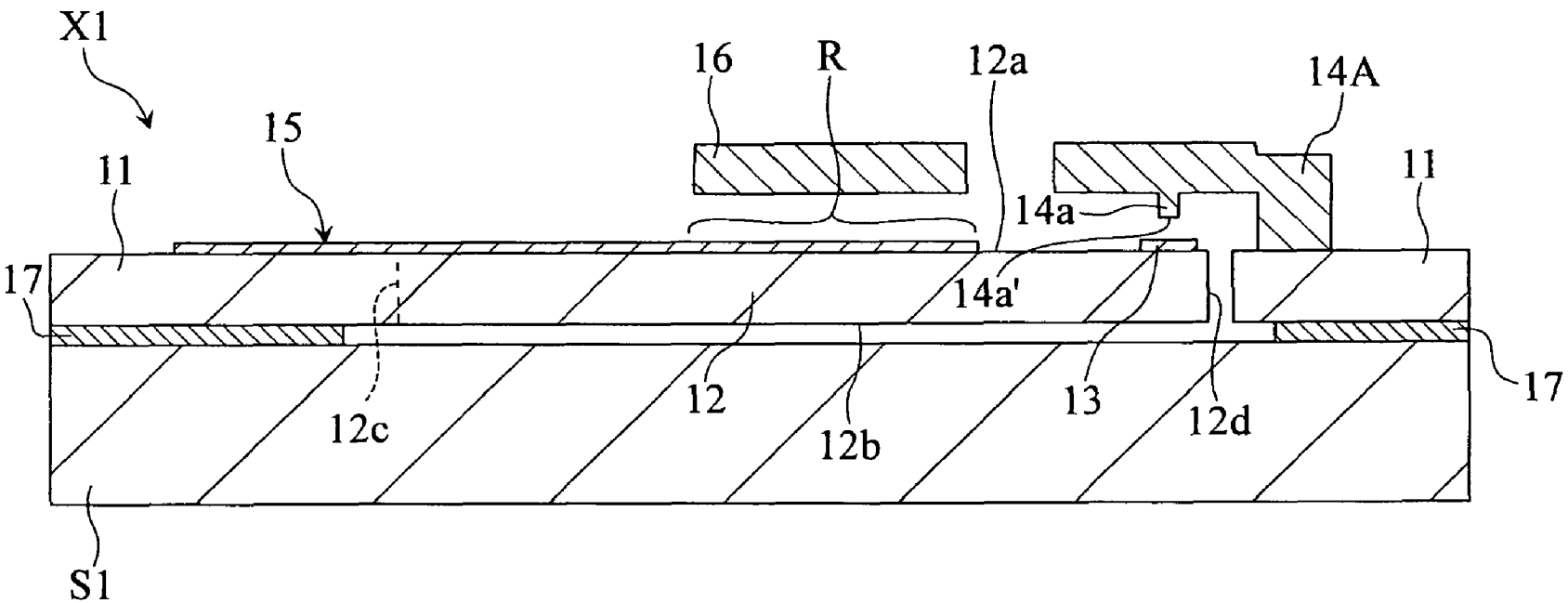
FIG. 5 is a sectional view taken along lines V-V in FIG. 1.

FIG. 1 through FIG. 5 show a micro-switching device X1 according to a first embodiment of the present invention. FIG. 1 is a plan view of the micro-switching device X1, and FIG. 2 is a partial plan view of the micro-switching device X1. FIG. 3 through FIG. 5 are sectional views taken along lines III-III, IV-IV, and V-V respectively in FIG. 1.

The micro-switching device X1 includes a base substrate S1, a fixing member 11, a movable part 12, a contact electrode 13, a pair of contact electrodes 14A, 14B (not illustrated in FIG. 2), a driver electrode 15, and a driver electrode 16 (not illustrated in FIG. 2).

As shown in FIG. 3 through FIG. 5, the fixing member 11 is bonded to the base substrate S1 via a boundary layer 17. The fixing member 11 is formed of monocrystalline silicon. The silicon material for the fixing member 11 preferably has a resistivity not smaller than 1000 ohm·cm. The boundary layer 17 is formed of silicon dioxide for example.

As shown in FIG. 1, FIG. 2 or FIG. 5 for example, the movable part 12 has a first surface 12*a* and a second surface 12*b*, a stationary end 12*c* fixed to a fixing member 11 and a free end 12*d*, extends along the base substrate S1, and is surrounded by the fixing member 11 via a slit 18. The movable part 12 has a thickness T indicated in FIG. 3 and FIG. 4, which is not greater than 15 μm. Also, as shown in FIG. 2, the movable part 12 has a length $L_1$ which is e.g. 650 through 1000 μm, and a length $L_2$ which is e.g. 200 through 400 μm. The slit 18 has a width of e.g. 1.5 through 2.5 μm. The movable part 12 is formed e.g. of monocrystalline silicon.

The contact electrode 13 serves as a movable contact electrode according to the present invention, and as shown clearly in FIG. 2, is provided on the first surface 12*a* of the movable part 12 near the free end 12*d*. (In other words, the contact electrode 13 is provided at a distance from the stationary end 12*c* of the movable part 12.) The contact electrode 13 has contact portions 13*a*', 13*b*'. The contact portion 13*a*' is contactable with the contact electrode 14A while the contact portion 13*b*' is contactable with the contact electrode 14B. For the sake of clarity, the contact portions 13*a*', 13*b*' are represented by solid black circles in FIG. 2. The contact electrode 13 has a thickness of e.g. 0.5 through 2.0 μm. Such a range of thickness is preferable for reduced resistivity of the contact electrode 13. The contact electrode 13 is formed of a predetermined electrically conductive material, and has e.g. a laminated structure provided by a Mo underlayer film and a Au film formed thereon.

Figure 6:
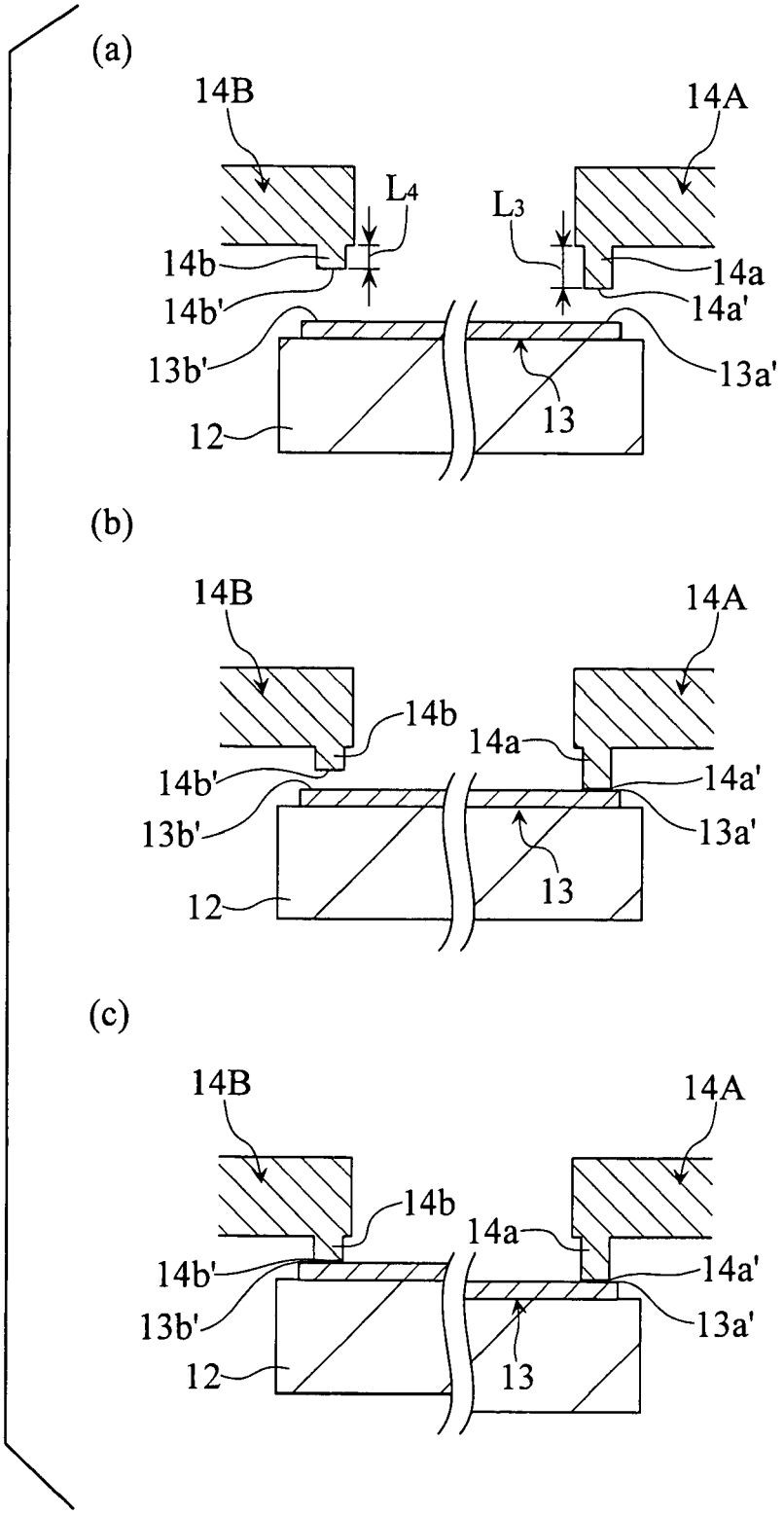
FIG. 6 illustrates how the micro-switching device shown in FIG. 1 operates.

The contact electrodes 14A, 14B serve as a first and a second stationary contact electrodes according to the present invention, are built on the fixing member 11 as shown in FIG. 3 and FIG. 5, and have projections 14*a*, 14*b*. The projection 14*a* has a tip functioning as a contact portion 14*a*' faced to a contact portion 13*a*' within the contact electrode 13 shown in FIG. 2. The projection 14*b* has a tip functioning as a contact portion 14*b*' faced to a contact portion 13*b*' within the contact electrode 13 shown in FIG. 2. As shown in FIG. 6(*a*), the projection 14*a* has a length of projection $L_3$ which is larger than a length of projection $L_4$ of the projection 14*b*. For example, the length of projection $L_3$ is 1 through 4 μm while the length of projection $L_4$ is 0.8 through 3.8 μm, provided that it is smaller than the length of projection $L_3$. Under a non-activated or an open state of the present device, the distance between the projection 14*a* or the contact portion 14*a*' and the contact electrode 13 or the contact portion 13*a*' is smaller than the distance between the projection 14*b* or the contact portion 14*b*' and the contact electrode 13 or the contact portion 13*b*'. Under the non-activated or the open state of the present device, the distance between the projection 14*a* or the contact portion 14*a*' and the contact portion 13*a*' is e.g. 0.1 through 2 μm. The distance between the projection 14*b* or the contact portion 14*b*' and the contact portion 13*b*' is e.g. 0.2 through 3 μm. Each of the contact electrodes 14A, 14B is connected with a predetermined circuit selected as an object of switching operation, via predetermined wiring (not illustrated). The contact electrodes 14A, 14B may be formed of the same material as is the contact electrode 13.

As shown clearly in FIG. 2, the driver electrode 15 extends on the movable part 12 and over to the fixing member 11. The driver electrode 15 has a thickness of e.g. 0.5 through 2 μm. The driver electrode 15 may be formed of Au.

The driver electrode 16 is for generation of electrostatic attraction (driving force) between itself and the driver electrode 15, and as shown clearly in FIG. 4, has its two ends bonded to the fixing member 11 so as to bridge over the driver electrode 15. The driver electrode 16 has a thickness which is not smaller than 15 μm for example. The driver electrode 16 is grounded via predetermined wiring (not illustrated). The driver electrodes 16 may be formed of the same material as is the driver electrode 15.

The driver electrodes 15, 16 constitute a drive mechanism according to the present invention, which includes, as shown in FIG. 2, a driving force generation region R on the first surface 12*a* of the movable part 12. As shown clearly in FIG. 4, the driving force generation region R according to the present embodiment is a region in the driver electrode 15 which faces the driver electrode 16.

As shown clearly in FIG. 2, in the micro-switching device X1, the movable part 12 has an asymmetric configuration. For example, the movable part 12 is asymmetric in such a way that with respect to a virtual straight line $F_1$ passing through the stationary end 12*c* of the movable part 12 and the contact portion 13*a*' of the contact electrode 13, the contact portion 13*b*' of the contact electrode 13 and the center of gravity of the movable part 12 lie on the same side. In addition to the configuration of the movable part 12, the micro-switching device X1 is asymmetric in the layout of contact portions 13*a*', 13*b*' in the contact electrode 13 (and therefore the layout of the contact portions 14*a*', 14*b*' in the contact electrodes 14A, 14B), as well as in the layout of the driving force generation region R in the drive mechanism constituted by the driver electrodes 15, 16. For example, the center of gravity C of the driving force generation region R is closer to the contact portion 13*b*' than to the contact portion 13*a*' of the contact electrode 13. The distance between the stationary end 12*c* and the contact portion 13*b*' of the contact electrode 13 is longer than the distance between the stationary end 12*c* of the movable part 12 and the contact portion 13*a*' of the contact electrode 13. Likewise, the center of gravity C of the driving force generation region R is offset from a virtual line $F_2$ which passes through a point $P_1$ that bisects the length of the stationary end 12*c* in the movable part 12 and a point $P_2$ that bisects the distance between the contact portions 13*a*', 13*b*' in the contact electrode 13, toward the contact portion 13*b*'.

In the micro-switching device X1 arranged as the above, electrostatic attraction is generated between the driver electrodes 15, 16 when an electric potential is applied to the driver electrode 15. With the applied electric potential being sufficiently high, the movable part 12 is elastically deformed until the contact electrode 13 makes contact with the contact electrodes 14A, 14B, i.e. with a pair of projections 14*a*, 14*b*, and thus a closed state of the micro-switching device X1 is achieved. In the closed state, the pair of contact electrodes 14A, 14B are electrically connected with each other by the contact electrode 13 to allow an electric current to pass through the contact electrodes 14A, 14B. In this way, it is possible to achieve an ON state of e.g. a high-frequency signal.

FIG. 6 shows an example process where the micro-switching device X1 changes its state from an open to a closed state. FIG. 6(*a*) through FIG. 6(*c*) each include a partial enlarged section of the projection 14*a* of the contact electrode 14A and its surrounds, as well as a partial enlarged section of the projection 14*b* of the contact electrode 14B and its surrounds.

As shown in FIG. 6(*a*), in a non-activated or an open state of the micro-switching device X1, the distance between the contact electrodes 13, 14A (i.e. between the contact portions 13*a*', 14*a*') is smaller than the distance between the contact electrodes 13, 14B (i.e. between the contact portions 13*b*', 14*b*'). If a voltage applied between the driver electrodes 15, 16 is gradually increased from 0 volt in such an open state, the electrostatic attraction between the driver electrodes 15, 16 also increases gradually, and because of this electrostatic attraction, the movable part 12 which extends along the base substrate S1 makes partial elastic deformation, and at a predetermined voltage $V_1$, the gap between the contact electrodes 13, 14A (i.e. between the contact portions 13*a*', 14*a*') is closed as shown in FIG. 6(*b*). According to the micro-switching device X1, the length of projection $L_3$ of the projection 14*a* is sufficiently larger than the length of projection $L_4$ of the projection 14*b* so as to allow the contact electrode 13 to make contact with the projection 14*a* of the contact electrode 14A before making a contact with the projection 14*b* of the contact electrode 14B. During such a process (the first process) from the open state shown in FIG. 6(*a*) through an intermediate state shown in FIG. 6(*b*), bending deformation occurs mainly in a portion of the movable part 12 ranging from a region corresponding to the driving force generation region R to the stationary end 12*a*. The first process can also be described as follows: Namely, a force acts on movable part 12 through a mechanism where the stationary end 12*c* of the movable part 12 functions as a fulcrum point or a fixed axis, with a working point of the force being the center of gravity C of a portion (driving force generation region R) which is a portion of the driver electrode 15, facing the driver electrode 16.

After the gap between the contact electrodes 13, 14A is closed as shown in FIG. 6(*b*), the voltage applied between the driver electrodes 15, 16 is increased further, to further increase the electrostatic attraction between the driver electrodes 15, 16. Then, at a predetermined voltage $V_2$ ($>V_1$), the gap between the contact electrodes 13, 14B (i.e. between the contact portions 13*b*', 14*b*') is closed as shown in FIG. 6(*c*). In such a process (the second process) from the intermediate state shown in FIG. 6(*b*) through the closed state shown in FIG. 6(*c*), torsional deformation occurs mainly in a portion of the movable part 12 ranging from the region corresponding to the driving force generation region R to the stationary end 12*c*. The second process can also be described as follows: Namely, a force acts on the movable part 12 through a mechanism shown in FIG. 2, where a virtual straight line $F_1$ which passes through the stationary end 12*c* of the movable part 12 and the point of contact provided by the contact electrodes 13, 14A represents a fixed axis or an axis of rotation, with a working point of the force being the center of gravity C of the driving force generation region R.

As described, in order to achieve a closed state in the micro-switching device X1, two steps are followed, i.e. the first process which is a process from the open state to the intermediate state shown in FIG. 6(*b*), and the second process which is a process from the intermediate state to the closed state shown in FIG. 6(*c*).

The first process and the second process differ from each other in the mode of deformation of the movable part 12. In the deformation mode of the first process, the stationary end 12*c* of the movable part 12 acts as a fulcrum point or a fixed axis, and the distance between the axis and the center of gravity C of the driving force generation region R (working point) is relatively long. For this reason, the first process requires a relatively small driving voltage $V_1$ or a small amount of electrostatic attraction for an amount of momentum generated to be in the center of gravity C in order to deform the movable part 12.

Then, in the deformation mode of the second process that follows, the process can be described as follows: Namely, a driving force acts on the movable part 12 through a mechanism where the virtual line $F_1$ which passes through the stationary end 12*c* of the movable part 12 and the point of contact provided by the contact electrodes 13, 14A represents a fixed axis or an axis of rotation, with a working point of the force being the center of gravity C of the driving force generation region R. This layout, where the center of gravity C of the driving force generation region R is closer to the contact portion 13*b*' of the contact electrode 13 than to the contact portion 13*a*' thereof, is preferable in providing a long distance between the center of gravity C (working point) in the driving force generation region R and the axis (virtual line $F_1$). The longer the distance between the axis and the center of gravity C (working point) in the driving force generation region R, the easier is it to generate a large momentum at the center of gravity C of the driving force generation region R during the deformation process of the movable part 12 before the gap between the contact electrode 13 and the contact electrode 14B (projection 14*b*, contact portion 14*b*') is closed, with a smaller minimum driving force (minimum electrostatic attraction) required for generation by the drive mechanism (the driver electrode 15, 16) in order to achieve the closed state. And, the smaller the minimum driving force is, the smaller is a minimum voltage which must be applied in order to achieve the closed state. Therefore, the micro-switching device X1 is suitable for reducing the driving voltage which must be applied to the drive mechanism in order to achieve the closed state.

Referring back to FIG. 6(*c*) on the other hand, with the micro-switching device X1 which now assumes the closed state, if the application of the electric potential is removed from the driver electrode 15, whereby the electrostatic attraction acting between the driver electrodes 15, 16, is cancelled, the movable part 12 returns to its natural state, causing the contact electrode 13 to come off the contact electrodes 14A, 14B. In this way, the open state of the micro-switching device X1 as shown in FIG. 3 and FIG. 5 is achieved. In the open state, the pair of contact electrodes 14A, 14B are electrically separated from each other, preventing an electric current from passing through the contact electrodes 14A, 14B. In this way, it is possible to achieve an OFF state of e.g. a high-frequency signal. The micro-switching device X1 which assumes such an open state as the above can be switched to the closed state again, by performing a sequence of closed state achieving processes which has been described earlier.

As has been described, according to the micro-switching device X1, it is possible to selectively switch between a closed state where the contact electrode 13 makes contact with both of the contact electrodes 14A, 14B, and an open state where the contact electrode 13 is moved off both of the contact electrodes 14A, 14B. Also, the micro-switching device X1 is suitable, as stated before, for reducing the driving voltage involved in the process of achieving the closed state.

As described earlier, the micro-switching device X1 is asymmetric in the configuration of the movable part 12, and in the layout of the contact portions 13*a*', 13*b*' in the contact electrode 13 (and therefore the layout of the contact portions 14*a*', 14*b*' in the contact electrodes 14A, 14B), as well as in the layout of the driving force generation region R in the drive mechanism constituted by the driver electrodes 15, 16. For example, the movable part 12 is asymmetric in such a way that the center of gravity C of the movable part 12 is on the same side of the contact portion 13*b*' of the contact electrode 13, with respect to the virtual line $F_1$ which passes through the stationary end 12*c* of the movable part 12 and the contact portion 13*a*' of the contact electrode 13. Likewise, the center of gravity C of the driving force generation region R is closer to the contact portion 13*b*' of the contact electrode 13 than to the contact portion 13*a*'. The distance between the stationary end 12*c* and the contact portion 13*b*' of the contact electrode 13 is longer than the distance between the stationary end 12*c* of the movable part 12 and the contact portion 13*a*' of the contact electrode 13. The center of gravity C of the driving force generation region R is offset from the virtual line $F_2$ which passes through a point $P_1$ that bisects the length of the stationary end 12*c* in the movable part 12 and a point $P_2$ that bisects the distance between the contact portions 13*a*', 13*b*', toward the contact portion 13*b*'. These asymmetric arrangements are preferable in providing a long distance between the center of gravity C (working point) in the driving force generation region R and the fixed axis (virtual line $F_1$) on the movable part 12.

Figure 7:
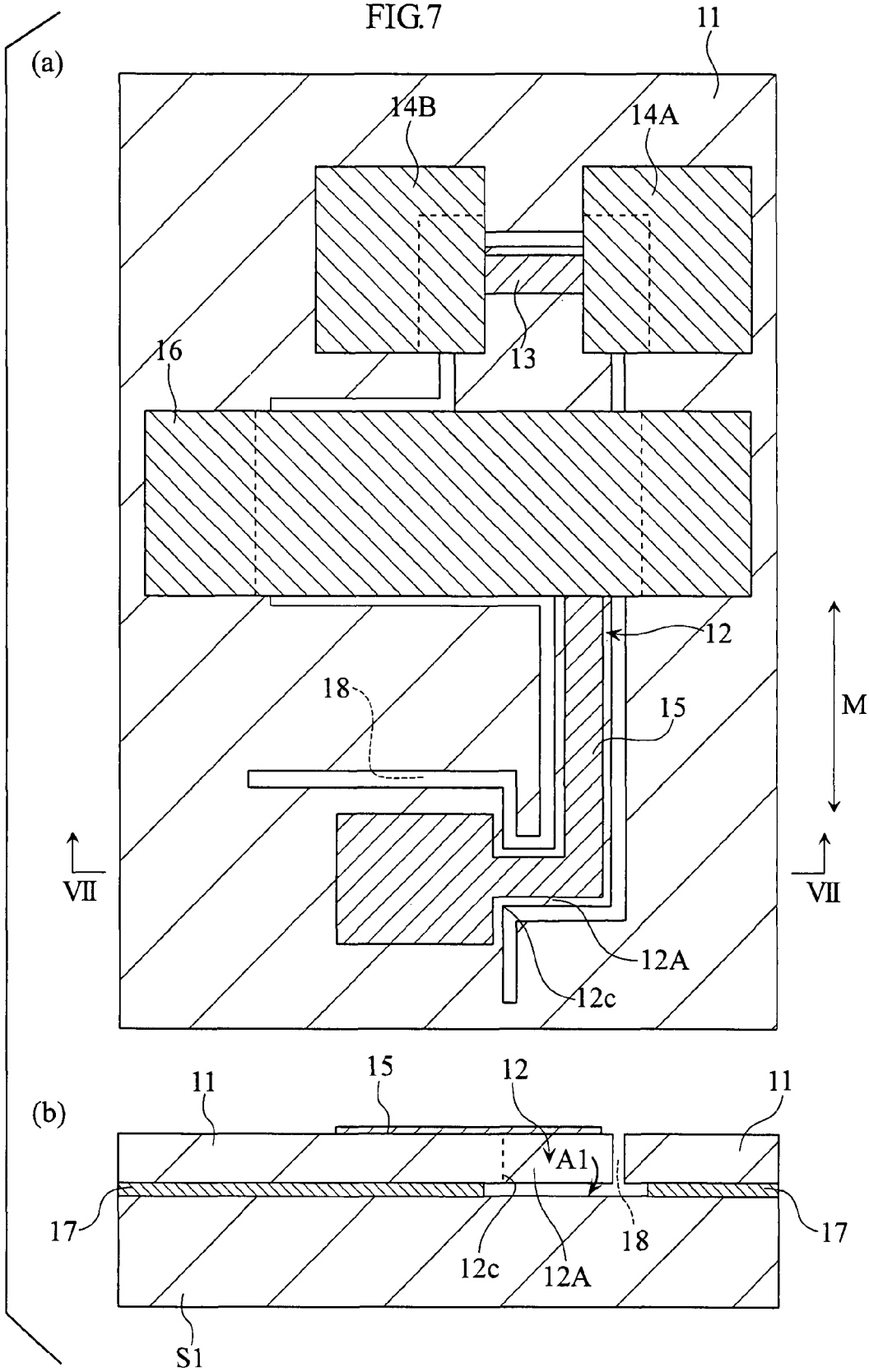
FIG. 7 shows a variation of the micro-switching device in FIG. 1, where (a) is a plan view of the device, and (b) is a sectional view taken along lines VII-VII in FIG. 7(*a*).

The movable part 12 may not be straight but bent as a whole, as shown in FIG. 7(*a*). A movable part 12 in FIG. 7(*a*) has a portion 12A which is fixed directly to the fixing member 11 at a stationary end 12*c* and extends perpendicularly to a main extension direction M of the movable part 12.

In the case where the movable part 12 has a nonlinear structure mentioned above, the bending deformation occurs as indicated by Arrow A1 in FIG. 7(*b*) mainly in the portion 12A which is the portion fixed to the fixing member 11 at the stationary end 12*c* in the second process or a process from the intermediate state shown in FIG. 6(*b*) through the closed state shown in FIG. 6(*c*). In such a second process, the process can also be described as follows: Namely, a force acts on movable part 12 through a mechanism, where a virtual straight line which passes through the stationary end 12*c* of the movable part 12 and the point of contact provided by the contact electrodes 13, 14A represents a fixed axis or an axis of rotation, with a working point of the force being the center of gravity C of the driving force generation region R.

In the second process according to the earlier embodiment, the movable part 12 has a configuration shown in FIG. 2 and receives torsional deformation in a portion from a region corresponding to the driving force generation region R to the stationary end 12*c*. In the present variation, bending deformation occurs in the portion 12A. The driving force which must be generated by the drive mechanism (the driver electrode 15, 16) in the second process tends to be smaller in the present variation than in the earlier embodiment where the movable part 12. Thus, the nonlinear structure of the movable part 12 is suitable for reducing the driving voltage which must be applied to the drive mechanism in order to achieve the closed state in the micro-switching device X1.

Figure 8:
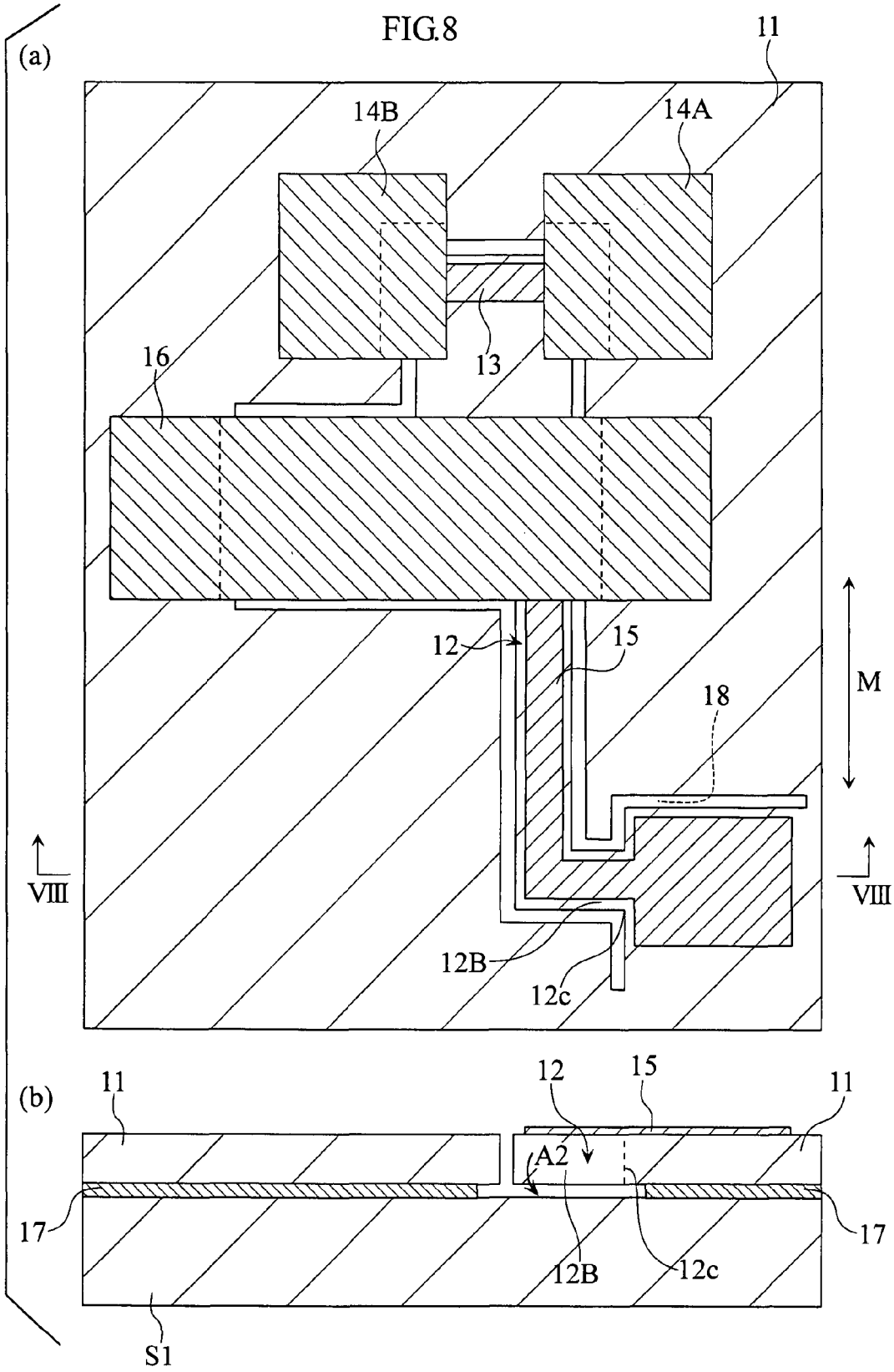
FIG. 8 shows another variation of the micro-switching device in FIG. 1, where (a) is a plan view of the device, and (b) is a sectional view taken along lines VIII-VIII in FIG. 8(*a*).

The movable part 12 may have another nonlinear structure as shown in FIG. 8(*a*). The movable part 12 in FIG. 8(*a*) has a portion 12B which is fixed directly to the fixing member 11 at a stationary end 12*c*, and extends perpendicularly to the main extension direction M of the movable part 12.

In the movable part 12, the bending deformation occurs as indicated by Arrow A2 in FIG. 8(*b*) mainly in the portion 12B which is a portion fixed to the fixing member at the stationary end 12*c* in the second process or a process from the intermediate state shown in FIG. 6(*b*) through the closed state shown in FIG. 6(*c*). In such a second process, the process can also be described as follows: Namely, a force acts on movable part 12 through a mechanism, where a virtual straight line which passes through the stationary end 12*c* of the movable part 12 and the point of contact provided by the contact electrodes 13, 14A represents a fixed axis or an axis of rotation, with a working point of the force being the center of gravity C of the driving force generation region R.

In the second process according to the earlier embodiment, the movable part 12 has a configuration shown in FIG. 2 and receives torsional deformation in a portion from a region corresponding to the driving force generation region R to the stationary end 12*c*. In the present variation, bending deformation occurs in the portion 12A. The driving force which must be generated by the drive mechanism (the driver electrode 15, 16) in the second process tends to be smaller in the present variation than in the earlier embodiment. Further, according to the present variation, it is easier than in the variation shown in FIG. 7, to provide a long distance between the center of gravity C (working point) in the driving force generation region R and the fixed axis or rotation axis in the second process. The longer the distance between the axis and the center of gravity C (working point) in the driving force generation region R, the easier is it to generate a large momentum in the center of gravity C of the driving force generation region R in the deformation process of the movable part 12 before the gap between the contact electrode 13 and the contact electrode 14B (projection 14*b* and contact portion 14*b*') is closed, with a smaller minimum driving force (minimum electrostatic attraction) required for generation by the drive mechanism (the driver electrode 15, 16) in order to achieve the closed state. As described, the nonlinear structure of the movable part 12 is advantageous in reducing the driving voltage to be applied to the drive mechanism in order to achieve the closed state.

Figure 9:
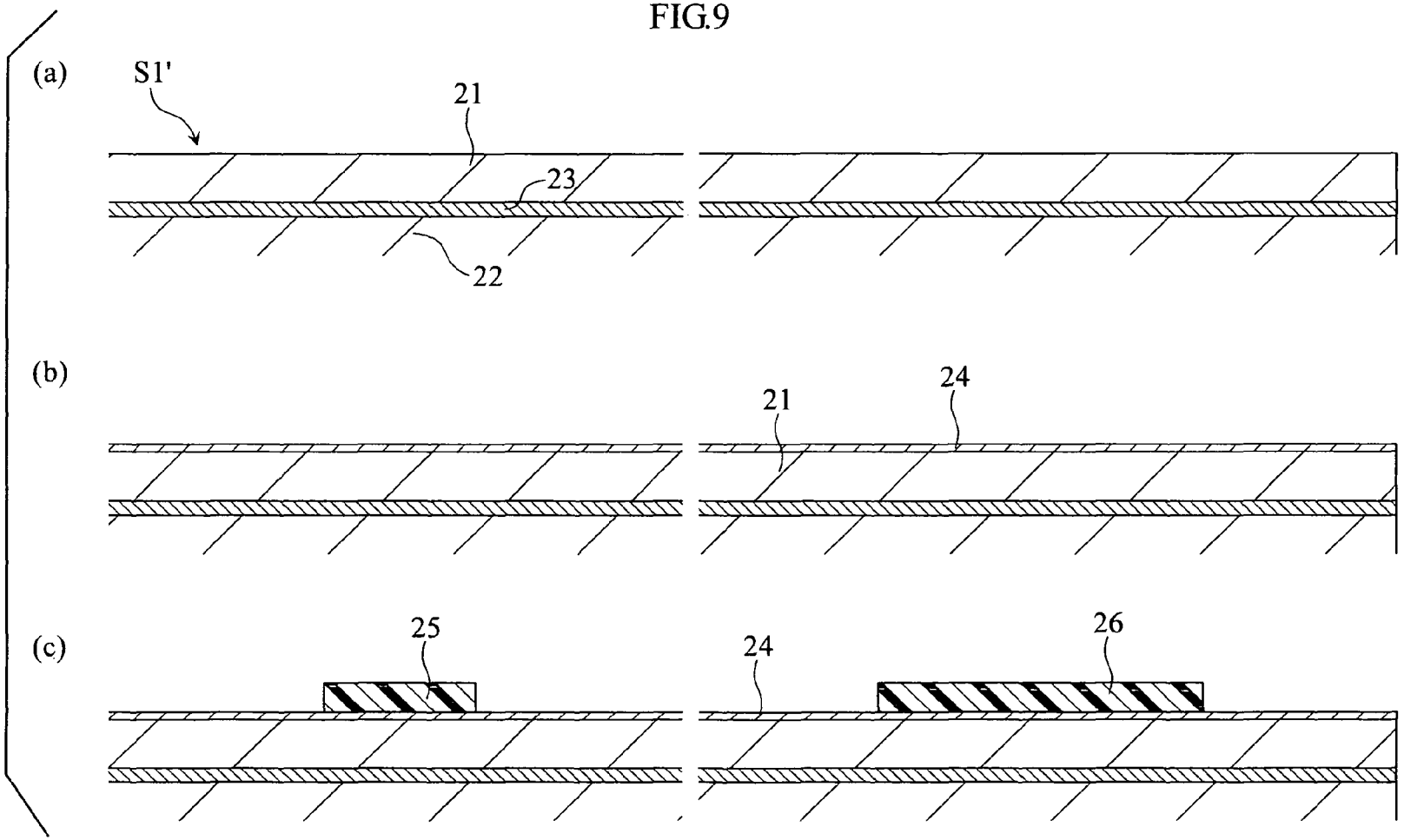
FIG. 9 shows several steps in a method of manufacturing the micro-switching device in FIG. 1.

FIG. 9 through FIG. 12 show a method of making the micro-switching device X1 in a series of sectional views illustrating changes in a section which is a section corresponding partially to those in FIG. 3 and FIG. 4. In the present method, first, a material substrate S1' as shown in FIG. 9(*a*) is prepared. The material substrate S1' is an SOI (Silicon on Insulator) substrate having a laminated structure which includes a first layer 21, a second layer 22 and an intermediate layer 23 between them. In the present embodiment, the first layer 21 has a thickness of 15 μm, the second layer 22 has a thickness of 525 μm, and the intermediate layer 23 has a thickness of 4 μm, for example. The first layer 21 is formed e.g. of monocrystalline silicon, and is processed into the fixing member 11 and the movable part 12. The second layer 22 is formed e.g. of monocrystalline silicon, and is processed into the base substrate S1. The intermediate layer 23 is formed e.g. of silicon dioxide, and is processed into the boundary layer.

Next, as shown in FIG. 9(*b*), a conductive film 24 is formed on the first layer 21 by using e.g. spattering method: A film of Mo is formed on the first layer 21 and then a film of Au is formed thereon. The Mo film has a thickness of e.g. 30 nm while the Au film has a thickness of e.g. 500 nm.

Next, as shown in FIG. 9(*c*), resist patterns 25, 26 are formed on the conductive film 24 by photolithography. The resist pattern 25 has a pattern for the contact electrode 13. The resist pattern 26 has a pattern for the driver electrode 15.

Figure 10:
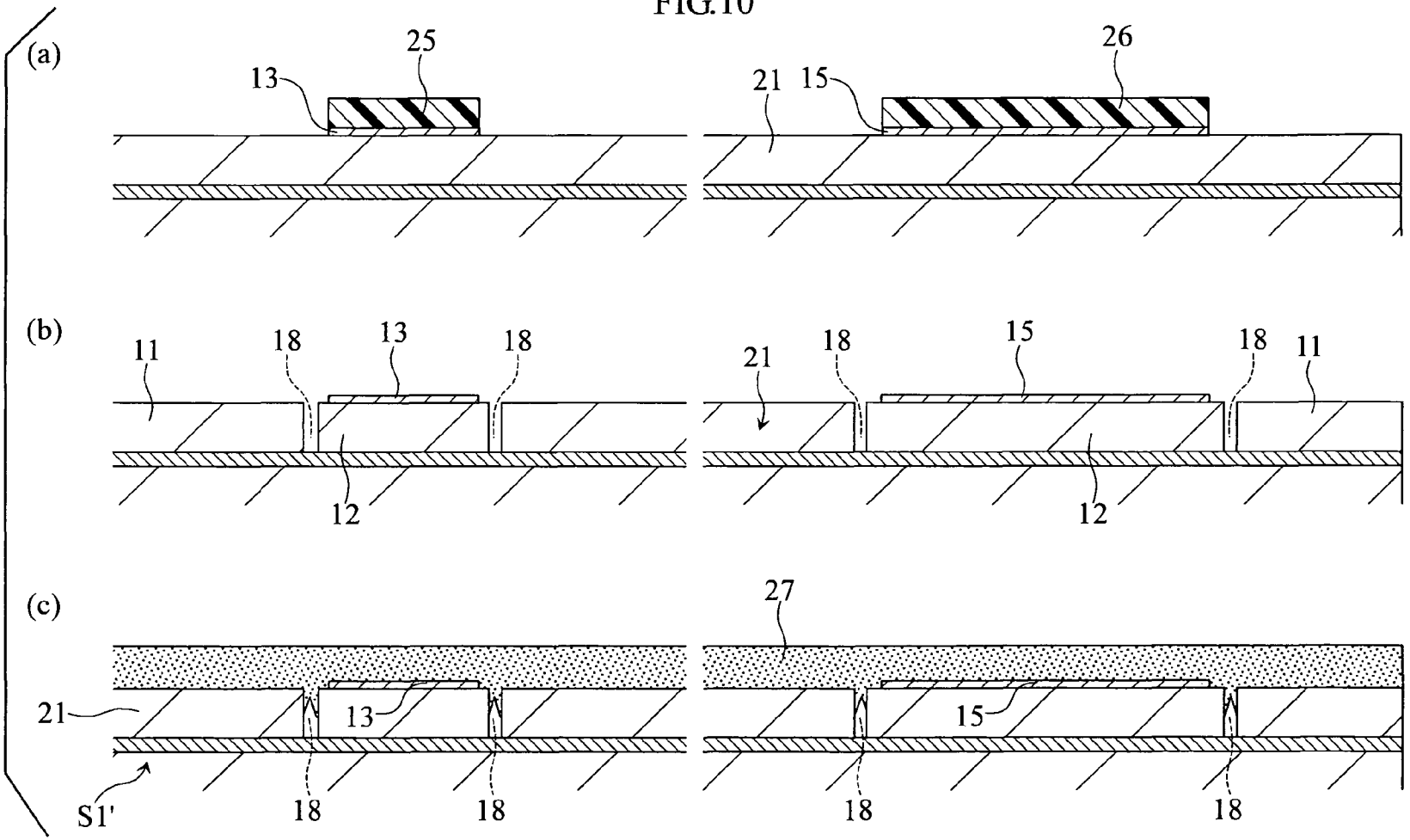
FIG. 10 shows steps following those in FIG. 9.

Next, as shown in FIG. 10(*a*), by using the resist patterns 25, 26 as masks, etching is performed to the conductive film 24 to form a contact electrode 13 and a driver electrode 15 on the first layer 21. The etching method to be employed in the present step may be ion milling (physical etching by e.g. Ar ions). Ion milling may also be used as a method of etching metal materials to be described later.

Next, the resist patterns 25, 26 are removed. Thereafter, as shown in FIG. 10(*b*), the first layer 21 is etched to form a slit 18. Specifically, a predetermined resist pattern is formed on the first layer 21 by photolithography, and then anisotropic etching is performed to the first layer 21, using the resist pattern as a mask. The etching method to be employed may be reactive ion etching. In the present step, a fixing member 11 and a movable part 12 are patterned.

Next, as shown in FIG. 10(*c*), a sacrifice layer 27 is formed, masking the slit 18, on a side which is designed to be the first layer 21 of the material substrate S1'. The sacrifice layer may be formed of e.g. silicon dioxide. The sacrifice layer 27 may be formed by e.g. plasma CVD method, spattering method, etc.

Figure 11:
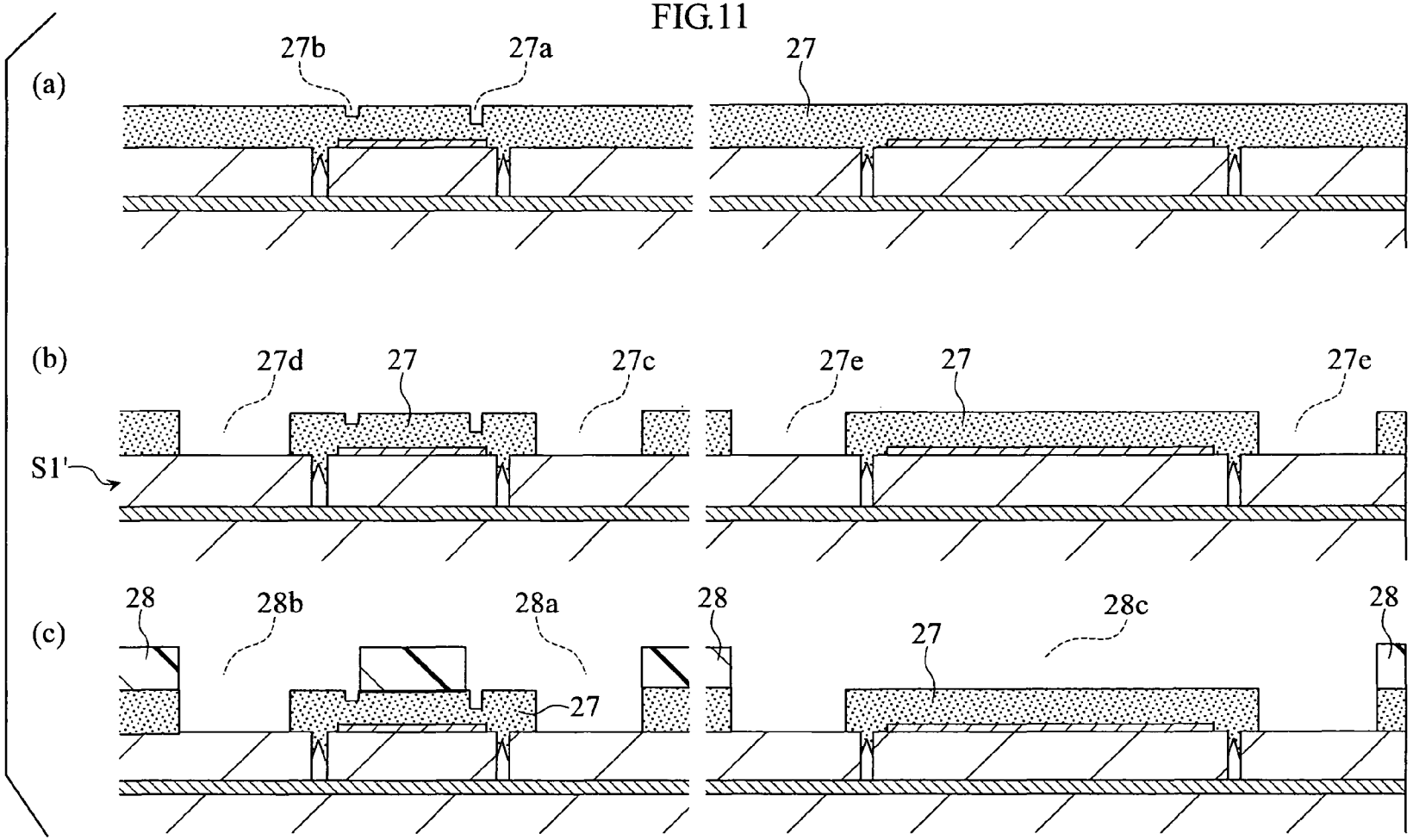
FIG. 11 shows steps following those in FIG. 10.

Next, as shown in FIG. 11(*a*), recesses 27*a*, 27*b* are formed at locations in the sacrifice layer 27 correspondingly to the contact electrode 13. Specifically, a predetermined resist pattern is formed on the sacrifice layer 27 by photolithography, and then etching is performed to the sacrifice layer 27, using the resist pattern as a mask. The etching may be wet etching. For wet etching, the etchant may be provided by e.g. buffered hydrofluoric acid (BHF). BHF may also be used in wet etching to be performed later to the sacrifice layer 27. The recess 27*a* is for formation of a projection 14*a* of a contact electrode 14A. The recess 27*a* has a depth of 1 through 4 μm. The recess 27*b* is for formation of a projection 14*b* of a contact electrode 14*b*. The recess 27*b* has a depth of 0.8 through 3.8 μm. By adjusting the depth of the recesses 27*a*, 27*b*, it is possible to adjust the distance from the contact electrode 13 to each of the projections 14*a*, 14*b* of the contact electrodes 14A, 14B.

Next, as shown in FIG. 11(*b*), the sacrifice layer 27 is patterned to form openings 27*c*, 27*d*, 27*e*. Specifically, a predetermined resist pattern is formed on the sacrifice layer 27 by photolithography, and then the sacrifice layer 27 is etched, using the resist pattern as a mask. The etching may be wet etching. The openings 27*c*, 27*d* serve to expose regions in the fixing member 11, for the contact electrodes 14A, 14B to bond to. The opening 27*e* serves to expose a region in the fixing member 11 for a driver electrode 16 to bond to.

Next, an underlying film (not illustrated) to be used for supplying power during an electroplating process is formed on a surface of the material substrate S1' which has been formed with the sacrifice layer 27. Thereafter, as shown in FIG. 11(*c*), a resist pattern 28 is formed. The underlying film can be formed, by spattering method for example, by first forming a film of Mo to a thickness of 50 nm and then forming a film of Au thereon, to a thickness of 500 nm. The resist pattern 28 has openings 28*a*, 28*b* which correspond to the contact electrodes 14A, 14B respectively, and an opening 28*c* which corresponds to the driver electrode 16.

Figure 12:
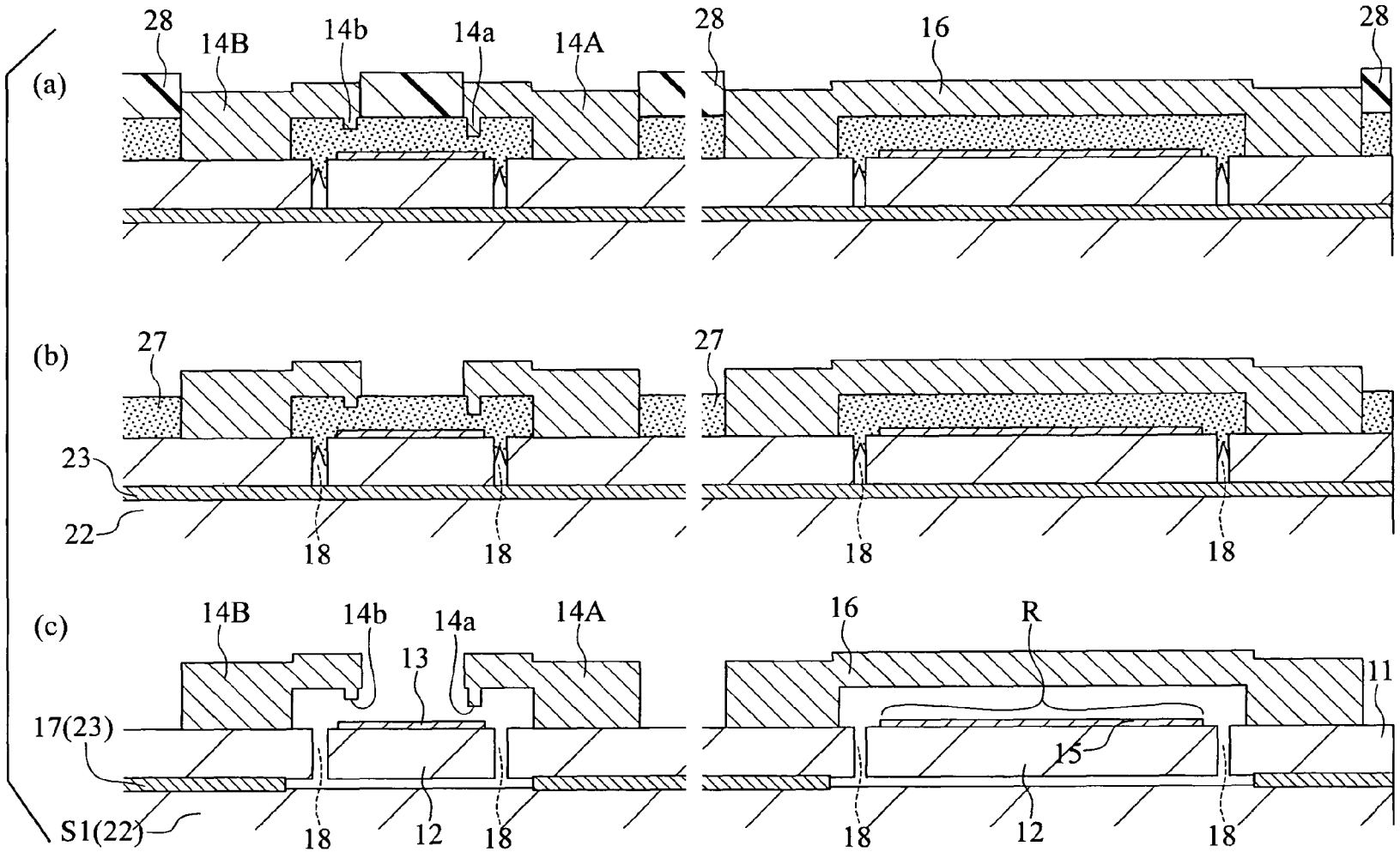
FIG. 12 shows steps following those in FIG. 11.

Next, as shown in FIG. 12(*a*), contact electrodes 14A, 14B and a driver electrode 16 are formed. Specifically, electroplating is performed to grow e.g. Au at places on the underlying film exposed by the openings 27*a* through 27*e*, and 28*a* through 28*c*.

Next, as shown in FIG. 12(*b*) the resist pattern 28 is etched off. Thereafter, portions exposed on the underlying film for electroplating are etched off. Each of these etching processes may be made by wet etching.

Next, as shown in FIG. 12(*c*), the sacrifice layer 27 and part of the intermediate layer 23 are removed. Specifically, wet etching is performed to the sacrifice layer 27 and the intermediate layer 23. In this etching process, first, the sacrifice layer 27 is removed and thereafter, part of the intermediate layer 23 is removed, starting from portions exposed to the slits 18. The etching process is stopped once a gap is formed appropriately, separating the entire movable part 12 from the second layer 22. As a result of the removal, a boundary layer 17 is left in the intermediate layer 23. The second layer 22 leaves a base substrate S1.

Next, wet etching is performed as necessary, to remove fractions of underlying film (e.g. Mo film) remaining on the contact electrode 14 and the driver electrode 16. Thereafter, the entire device is dried by supercritical drying method. Supercritical drying method enables to avoid sticking phenomenon, i.e. a problem that the movable part 12 sticks to the base substrate S1 for example.

The micro-switching device X1 can be manufactured by following the steps described above. According to the present method, the contact electrodes 14A, 14B which have portions to face the contact electrode 13 can be formed thickly on the sacrifice layer 27 by using plating method. Therefore, it is possible to give the pair of contact electrodes 14A, 14B a sufficient thickness for achieving a desirably low resistance. Thick contact electrodes 14A, 14B are suitable in reducing the insertion loss of the micro-switching device X1.

Figure 13:
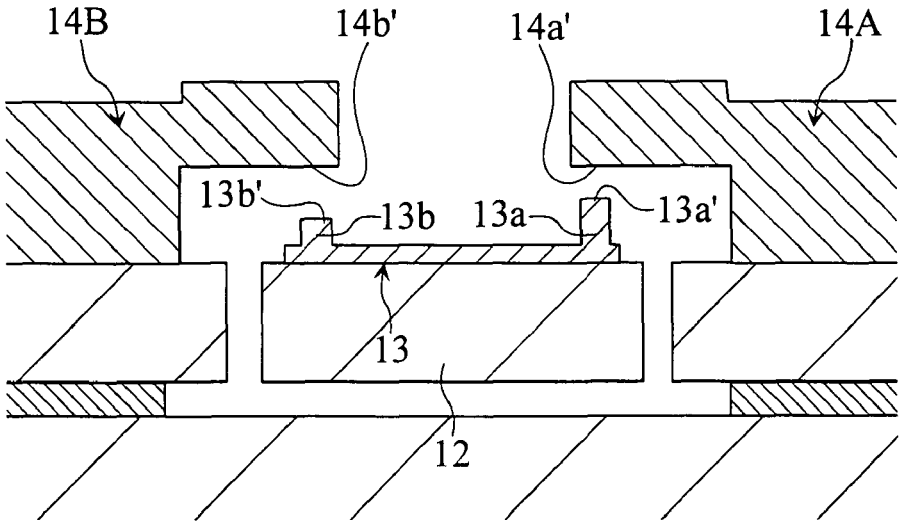
FIG. 13 is an enlarged partial view of a variation of the micro-switching device in FIG. 1.

The contact electrodes 13, 14A, 14B in the micro-switching device X1 have a structure shown in FIG. 3; however, they may have a structure as shown in FIG. 13. In the structure depicted in FIG. 13, the contact electrode 13 has projections 13*a*, 13*b*. The projection 13*a* has a tip serving as a contact portion 13*a*', while the projection 13*b* has a tip serving as a contact portion 13*b*'. The projection 13*a* has a length of projection which is larger than a length of projection of the projection 13*b*. For example, the length of projection of the projection 13*a* is 1 through 4 μm, while the length of projection of the projection 13*b* is 0.8 through 3.8 μm. On the other hand, the contact electrode 14 does not have a projection but has contact portions 14*a*', 14*b*'. The contact portion 14*a*' is contactable with the projection 13*a*, i.e. the contact portion 13*a*' of the contact electrode 13 whereas the contact portion 14*b*' is contactable with the projection 13*b*, i.e. the contact portion 13*b*'. Under a non-activated or an open state of the present device, the distance between the projection 13*a* or contact portion 13*a*' and the contact electrode 14 or contact portion 14*a*' is smaller than the distance between the projection 13*b* or contact portion 13*b*' and the contact electrode 14 or contact portion 14*b*'. Under the non-activated or the open state, the distance between the contact portions 13*a*', 14*a*' is e.g. 0.1 through 2 μm whereas the distance between the contact portions 13*b*', 14*b*' is e.g. 0.2 through 3 μm.

When making a micro-switching device X1 which has such a structure as the above, the following additional steps are used for example: Specifically, after the step described with reference to FIG. 10(*b*), projections 13*a*, 13*b* are formed on the contact electrode 13, and thereafter, the sacrifice layer 27 is formed as described with reference to FIG. 10(*c*) while covering the projections 13*a*, 13*b*. It should be noted that formation of the recesses 27*a*, 27*b* described with reference to FIG. 11(*a*) is not performed.

Figure 14:
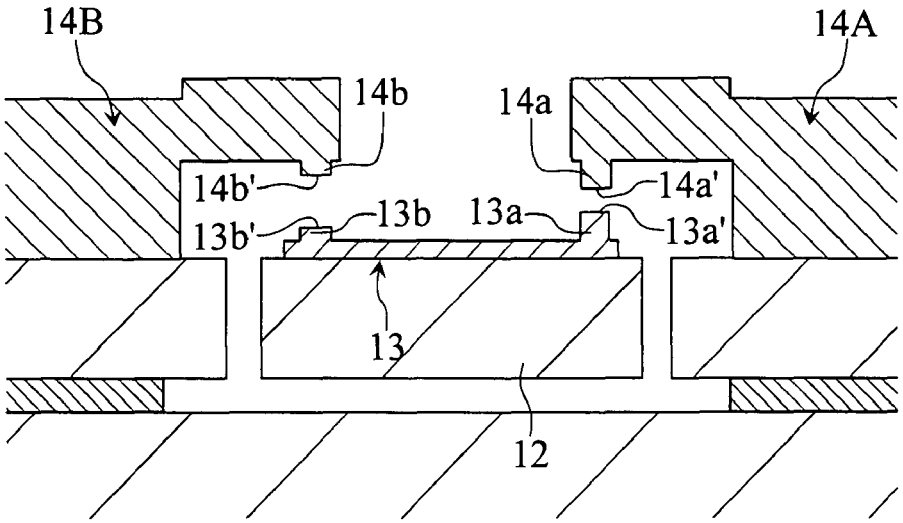
FIG. 14 is an enlarged partial view of another variation of the micro-switching device in FIG. 1.

Referring back to the micro-switching device X1 which has contact electrodes 13, 14A, 14B of a structure shown in FIG. 3, these electrodes may have a structure as shown in FIG. 14. In the structure depicted in FIG. 14, the contact electrode 14 has projections 14*a*, 14*b*, and the contact electrode 13 has projections 13*a*, 13*b*. The projection 13*a* has a tip serving as a contact portion 13*a*' while the projection 13*b* has a tip serving as a contact portion 13*b*'. Under a non-activated or an open state of the present device, the distance between the contact portions 13*a*', 14*a*' is smaller than the distance between the contact portions 13*b*', 14*b*'. Under the non-activated or the open state, the distance between the contact portions 13*a*', 14*a*' is e.g. 0.1 through 2 μm, whereas the distance between the contact portion 13*b*', 14*b*' is e.g. 0.2 through 3 μm.

When making a micro-switching device X1 which has such a structure as the above, the following additional steps are used for example: Specifically, after the step described with reference to FIG. 10(*b*), projections 13*a*, 13*b* are formed on the contact electrode 13, and thereafter, the sacrifice layer 27 is formed as described with reference to FIG. 10(*c*), while covering the projections 13*a*, 13*b*.

Referring back to the micro-switching device X1 which has a structure shown in FIG. 3, the length of projection $L_3$ of the projection 14*a* in the contact electrode 14A may be equal to the length of projection $L_4$ of the projection 14*b* in the contact electrode 14B. The movable part 12 is asymmetric in such a way that with respect to the virtual line $F_1$ which passes through the stationary end 12*c* of the movable part 12 and the contact portion 13*a*' of the contact electrode 13, the contact portion 13*b*' of the contact electrode 13 and the center of gravity of the movable part 12 lie on the same side. Because of such an asymmetric configuration, the movable part 12 deforms due to its own weight, often coming to a state where the distance between the contact electrode 13 and the contact electrode 14B formed on the movable part is wider than the distance between the contact electrodes 13, 14A. In this case, it is possible to make the distance between the projection 14*a* or contact portion 14*a*' and the contact electrode 13 or the contact portion 13*a*' smaller than the distance between the projection 14*b* or contact portion 14*b*' and the contact electrode 13 or the contact portion 13*b*' under a non-activated or an open state of the device, even if the length of projection $L_3$ of the projection 14*a* is identical with the length of projection $L_4$ of the projection 14*b*.

Figure 15:
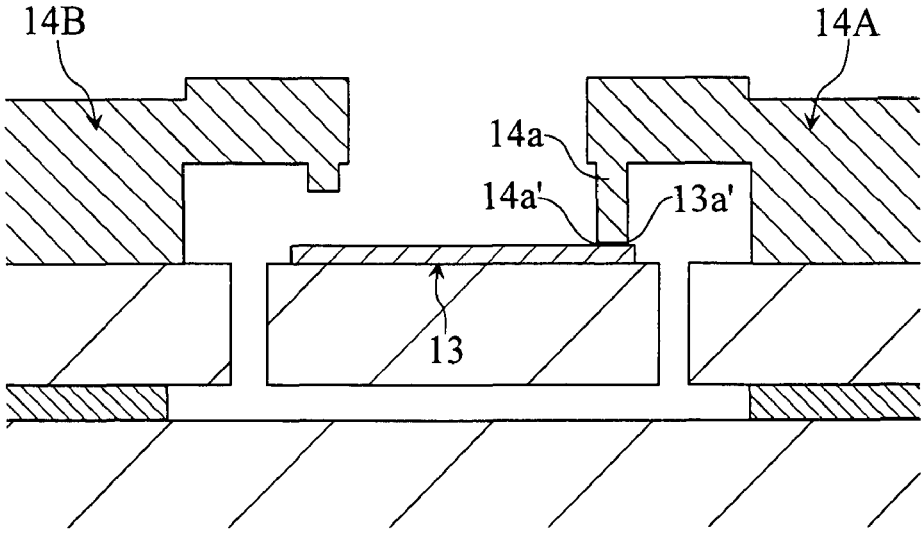
FIG. 15 is an enlarged partial view of another variation of the micro-switching device in FIG. 1.

In the micro-switching device X1, the projection 14*a* or the contact portion 14*a*' of the contact electrode 14A may be in contact with the contact portion 13*a*' of the contact electrode 13 as shown in FIG. 15.

When making such a structure, the recess 27*a* is formed sufficiently deep in the step described with reference to FIG. 11(*a*). Specifically for example, the recess 27*a* is formed so as to give the sacrifice layer 27 a thickness of 5 μm between the recess 27*a* and the contact electrode 13. If the recess 27*a* is made to such a depth, a long projection 14*a* is formed in the recess 27*a* in the step described with reference to FIG. 12(*a*). Then, as the sacrifice layer 27 is etched off in the step described with reference to FIG. 12(*c*), the projection 14*a* of the contact electrode 14A and the contact electrode 13 come into contact as shown in FIG. 15. This is due to internal stress within the contact electrode 13 resulting from the thin-film formation technology, which causes the contact electrode 13 and the movable part 12 bonded thereto to warp toward the contact electrodes 14A, 14B after the step described with reference to FIG. 12(*c*).

Figure 16:
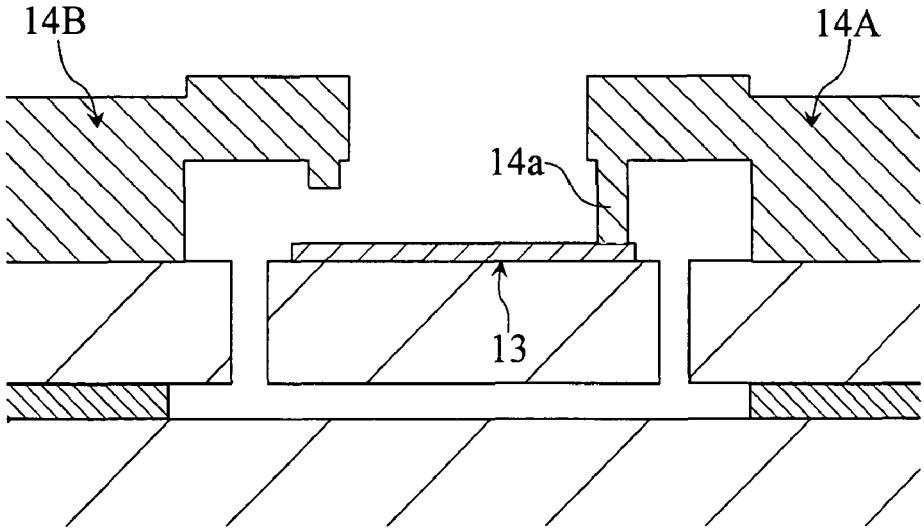
FIG. 16 is an enlarged partial view of another variation of the micro-switching device in FIG. 1.

In the micro-switching device X1, the projection 14*a* of the contact electrode 14A may be in contact with the contact electrode 13 as shown in FIG. 16.

When making such a structure, the recess 27*a* is formed so as to penetrate the sacrifice layer 27 in the step described with reference to FIG. 11(*a*). Then, in the step described with reference to FIG. 12(*a*), a projection 14*a* is formed as bonded to the contact electrode 13 in the recess 27*a*.

The arrangements shown in FIG. 15 and FIG. 16 are suitable to reduce discrepancies in orientation of the contact electrode 13 on the movable part 12 to the contact electrodes 14A, 14B under a non-activated or an open state of the micro-switching device X1. The reduction in discrepancies is advantageous in reducing the driving voltage of the micro-switching device X1.

Figure 17:
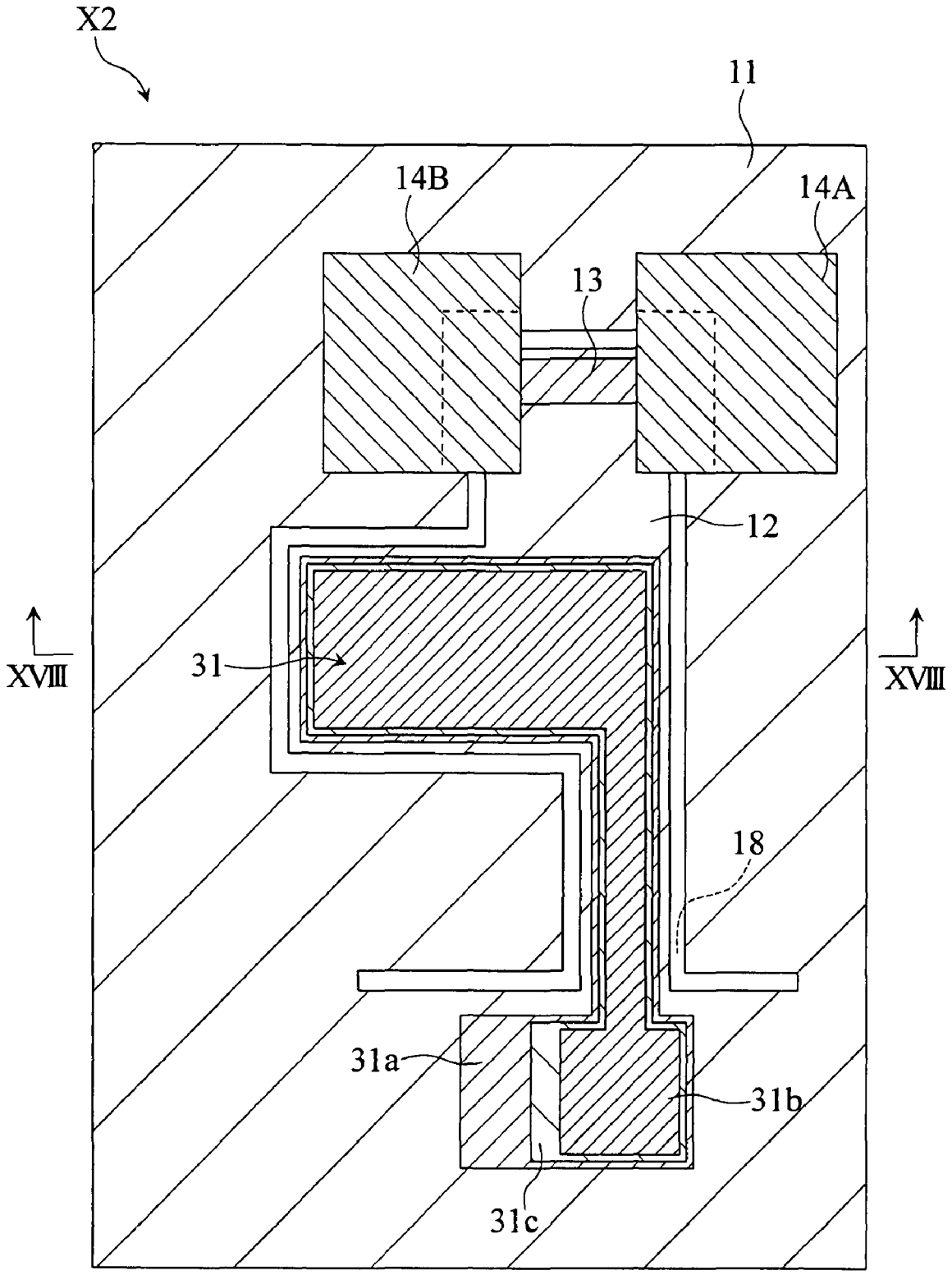
FIG. 17 is a plan view of a micro-switching device according to a second embodiment of the present invention.
Figure 18:
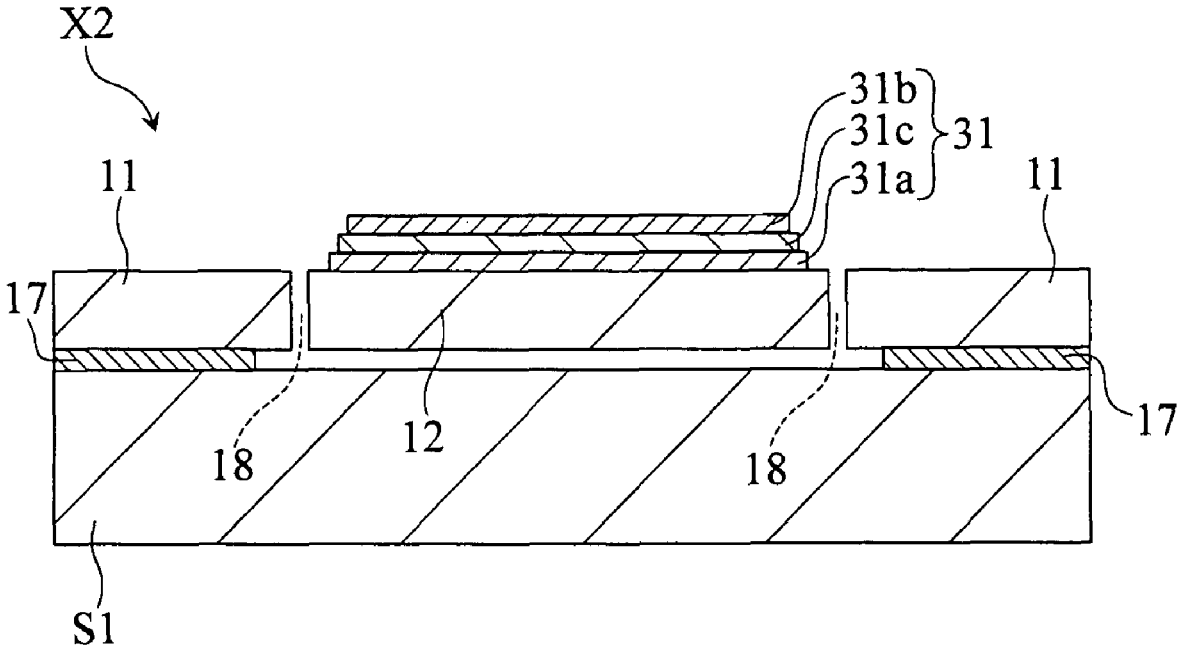
FIG. 18 is a sectional view taken along lines XVIII-XVIII in FIG. 17.

FIG. 17 and FIG. 18 show a micro-switching device X2 according to a second embodiment of the present invention. FIG. 17 is a plan view of the micro-switching device X2 whereas FIG. 18 is a sectional view taken along lines XVIII-XVIII in FIG. 17.

The micro-switching device X2 includes a base substrate S1, a fixing member 11, a movable part 12, a contact portion 13, a pair of contact electrodes 14A, 14B, and a piezoelectric driver portion 31. The micro-switching device X2 differs from the micro-switching device X1 in that it includes the piezoelectric driver portion 31 instead of the driver electrodes 15, 16.

The piezoelectric driver portion 31 includes driver electrodes 31*a*, 31*b* and a piezoelectric film 31*c* between the electrodes. Each of the driver electrodes 31*a*, 31*b* has a laminated structure provided by e.g. a Ti underlayer and a Au main layer. The driver electrode 31*b* is grounded via predetermined wiring (not illustrated). The piezoelectric film 31*c* is provided by a piezoelectric material, i.e. a material which is distorted by an electric field (inverse piezoelectric effect) The piezoelectric material may be provided by PZT (a solid solution of $PbZrO_3$ and $PbTiO_3$), ZnO doped with Mn, ZnO or AlN. The driver electrode 31*a*, 31*b* have a thickness of e.g. 0.55 μm while the piezoelectric film 31*c* has a thickness of e.g. 1.5 μm.

The drive mechanism in the micro-switching device according to the present invention may be provided by such a piezoelectric driver portion 31 described above. As the piezoelectric driver portion 31 operates, a switching operation is made on the present device.

Figure 19:
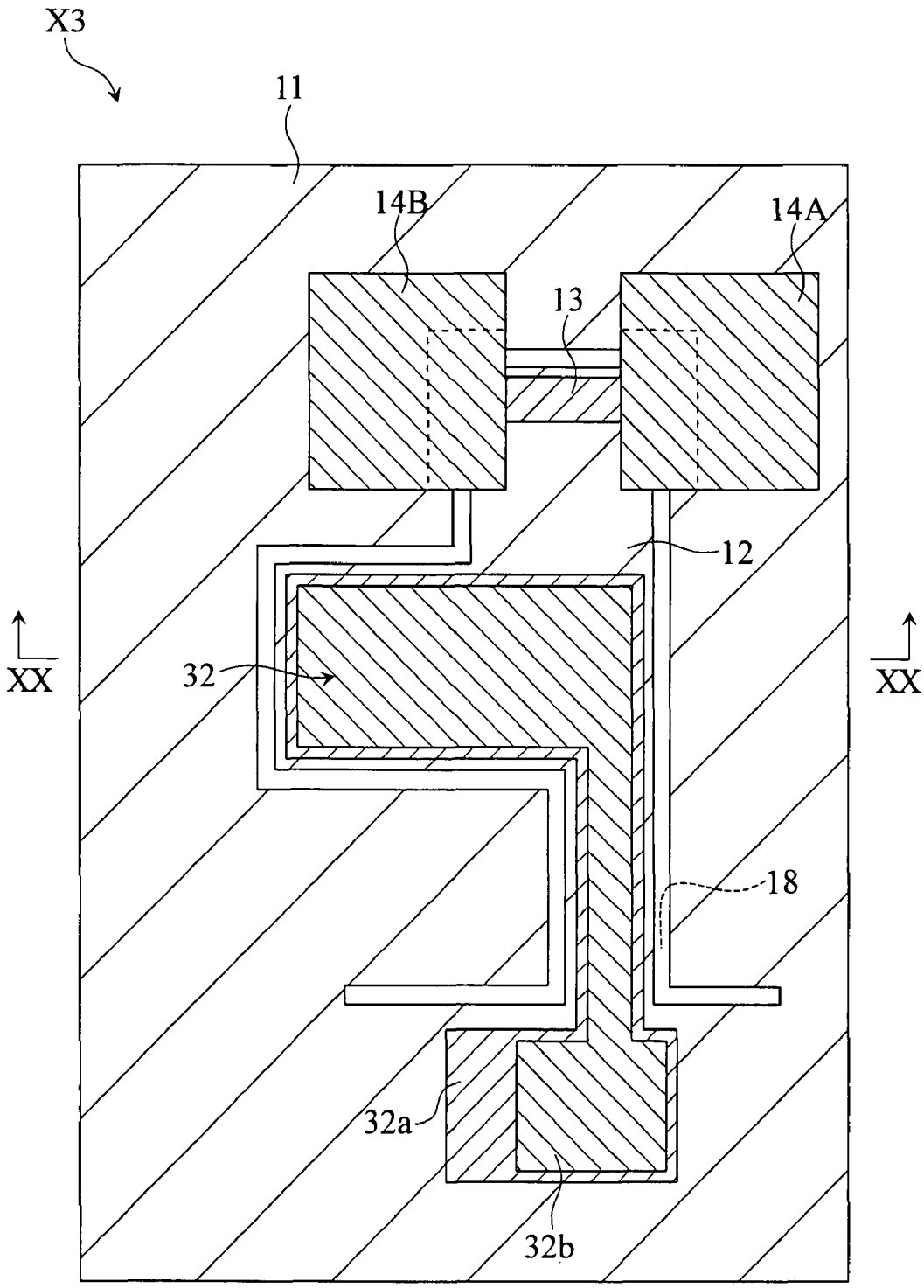
FIG. 19 is a plan view of a micro-switching device according to a third embodiment of the present invention.
Figure 20:
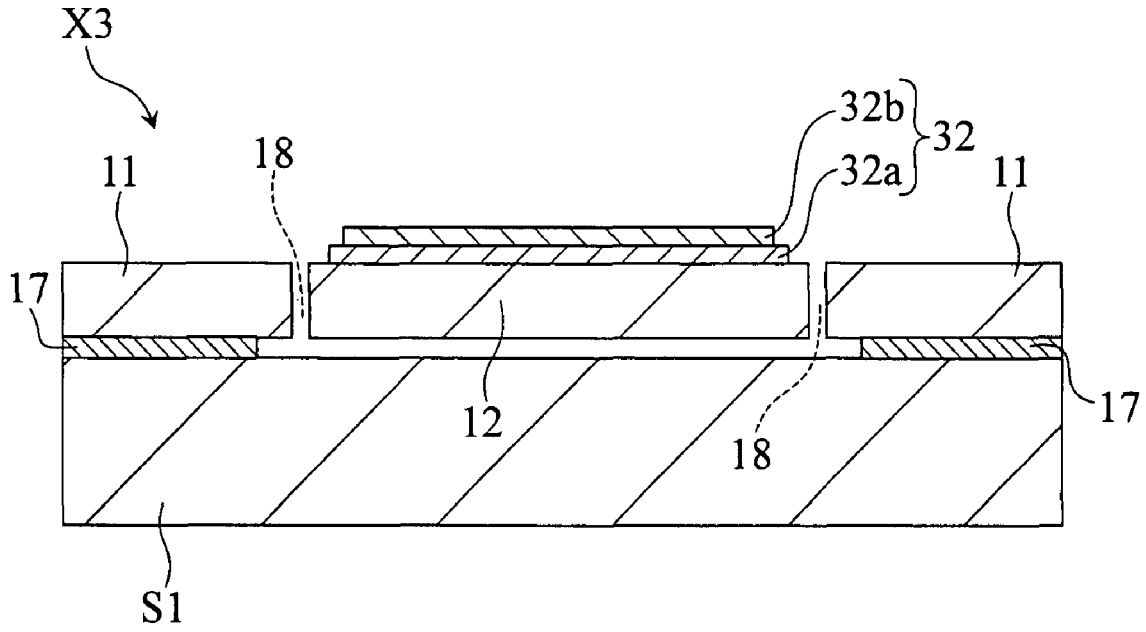
FIG. 20 is a sectional view taken along lines XX-XX in FIG. 19.
Figure 21:
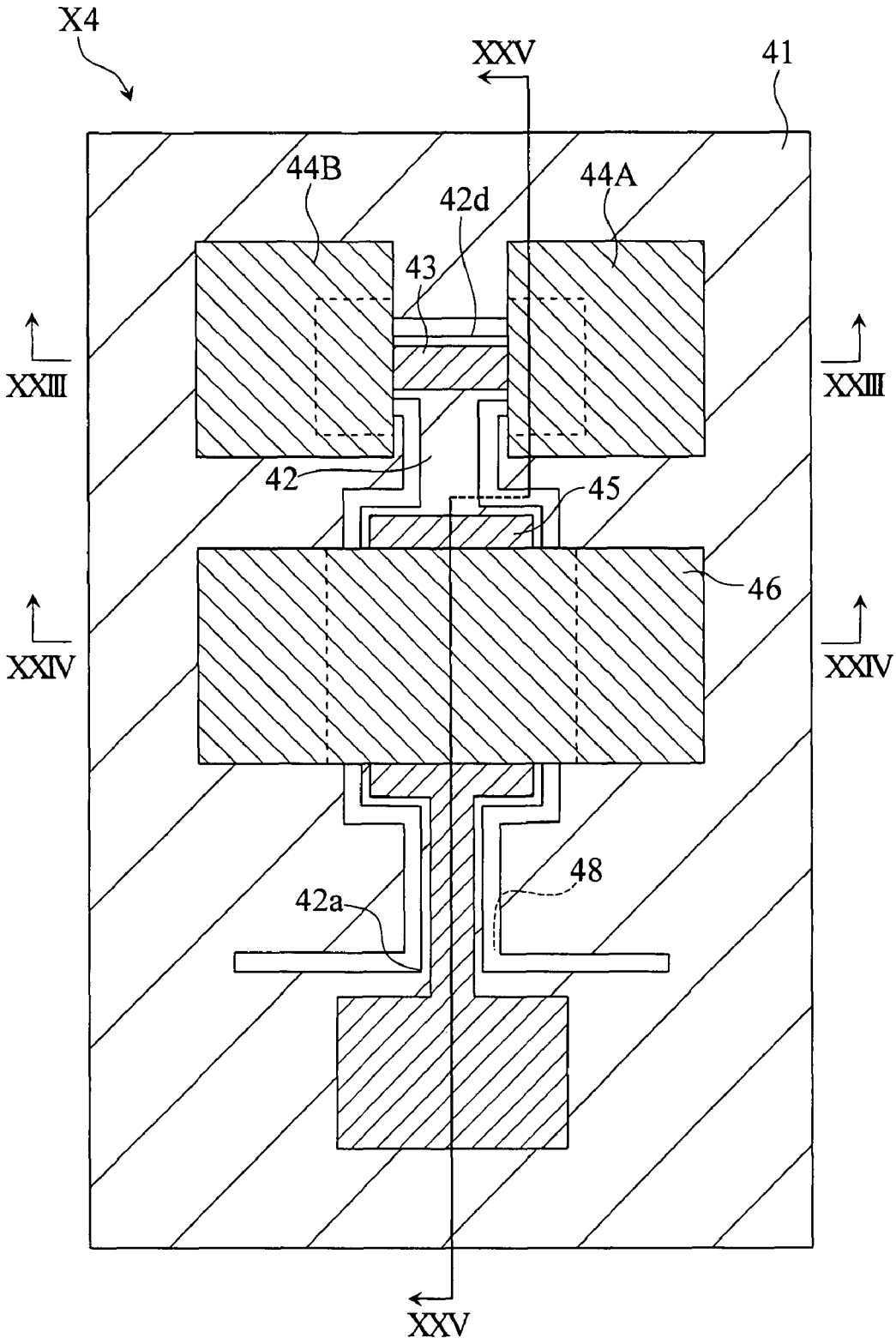
FIG.21 Prior Art
FIG. 21 is a plan view of conventional micro-switching device.
Figure 22:
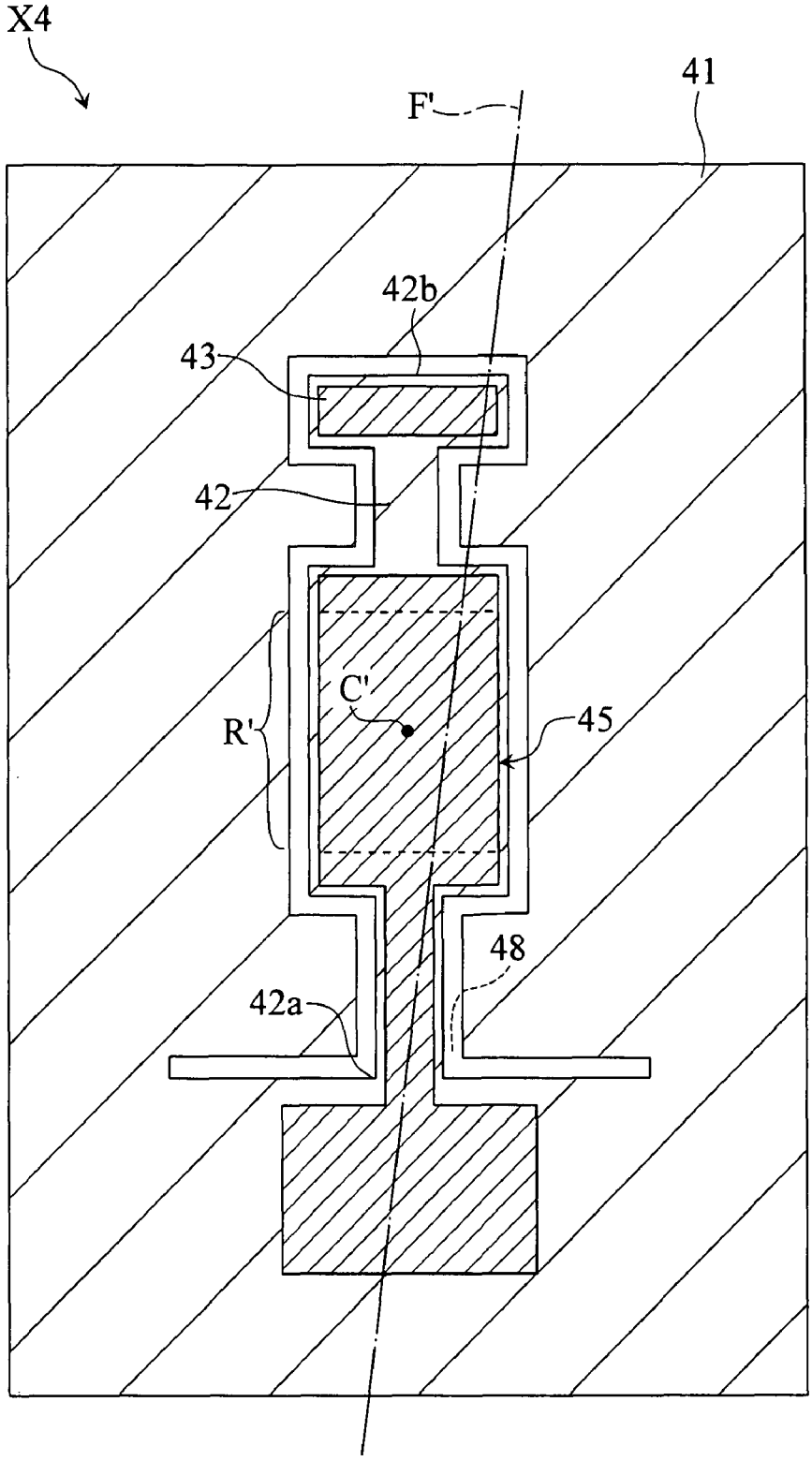
FIG.22 Prior Art
FIG. 22 is a partial plan view of the micro-switching device in FIG. 21.
Figure 23:
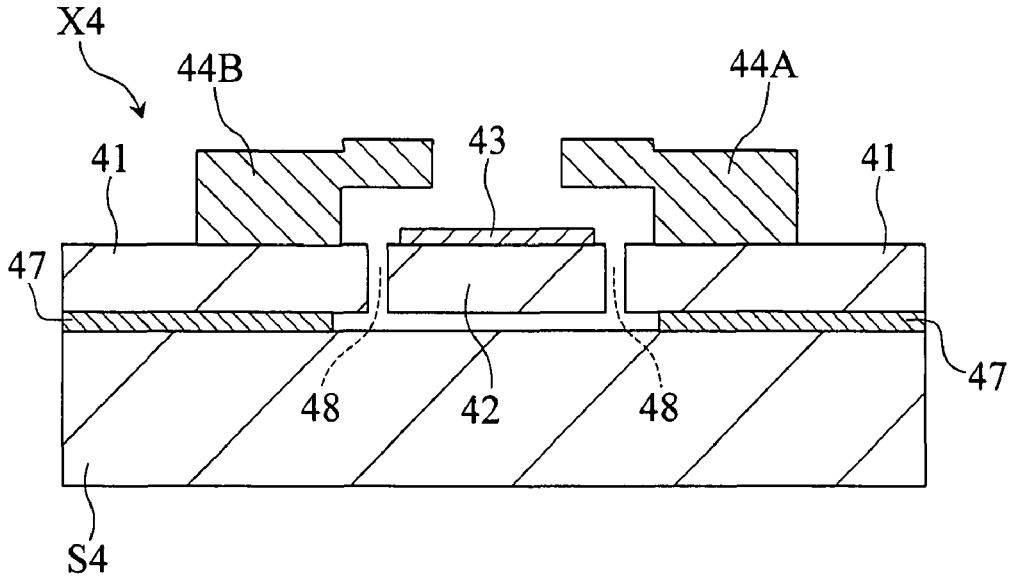
FIG.23 Prior Art
FIG. 23 is a sectional view taken along lines XXIII-XXIII in FIG. 21.
Figure 24:
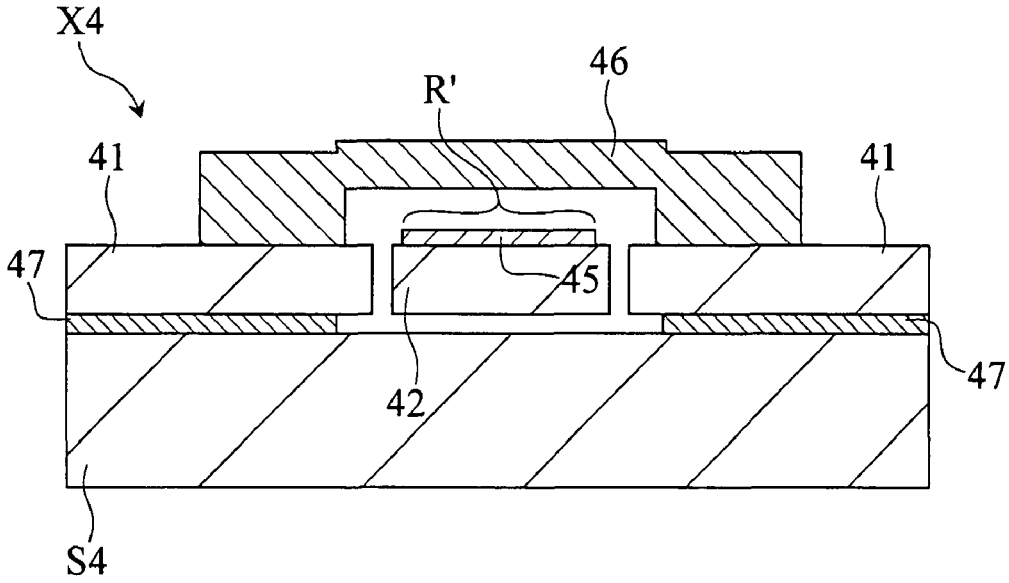
FIG.24 Prior Art
FIG. 24 is a sectional view taken along lines XXIV-XXIV in FIG. 21.
Figure 25:
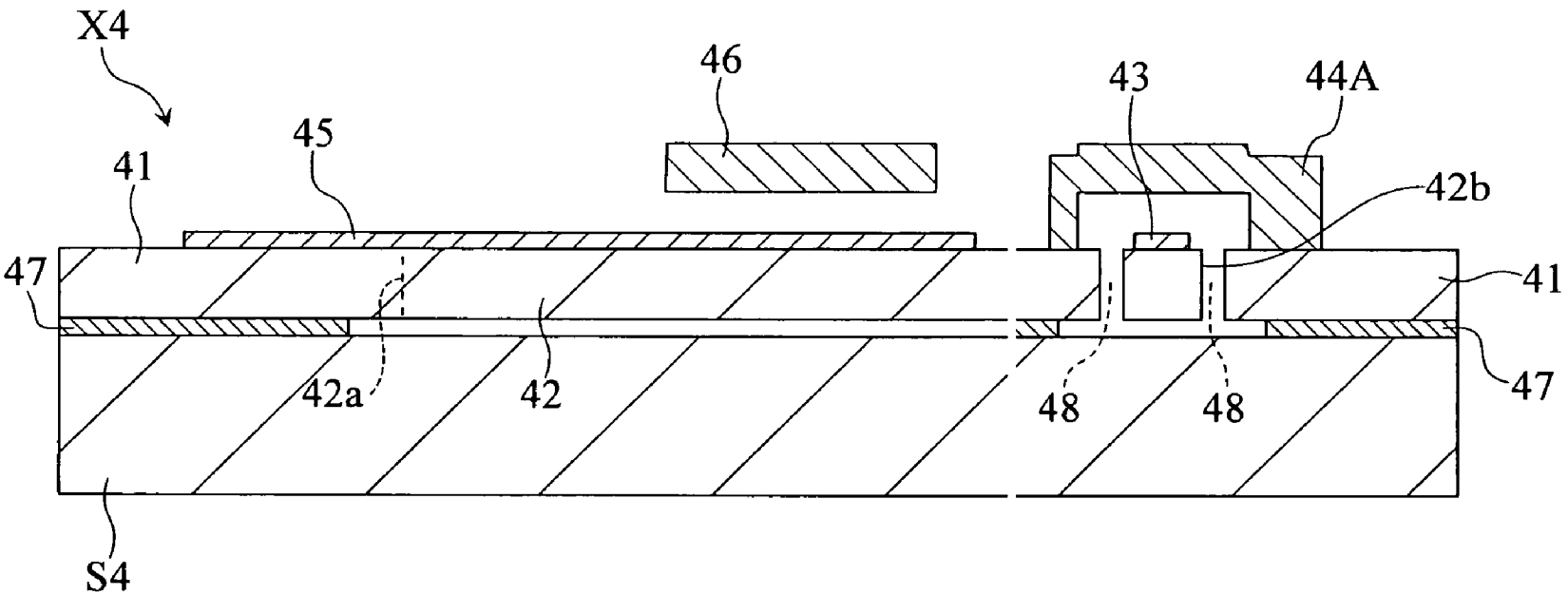
FIG.25 Prior Art
FIG. 25 is a sectional view taken along lines XXV-XXV in FIG. 21.
Figure 26:
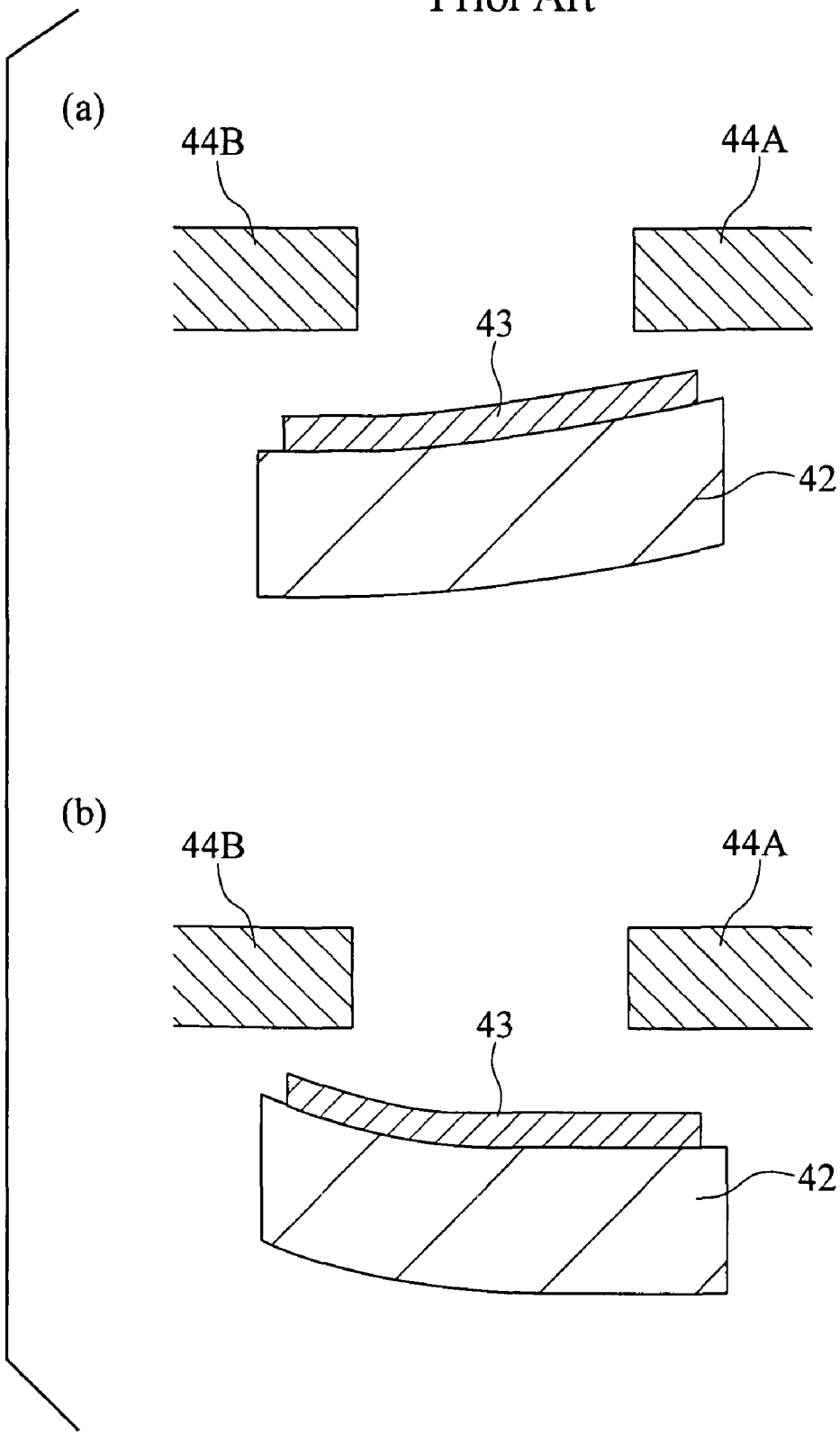
FIG.26 Prior Art
FIG. 26 shows deformation in a movable part and a contact electrode thereon in an exaggerated form.
Figure 27:
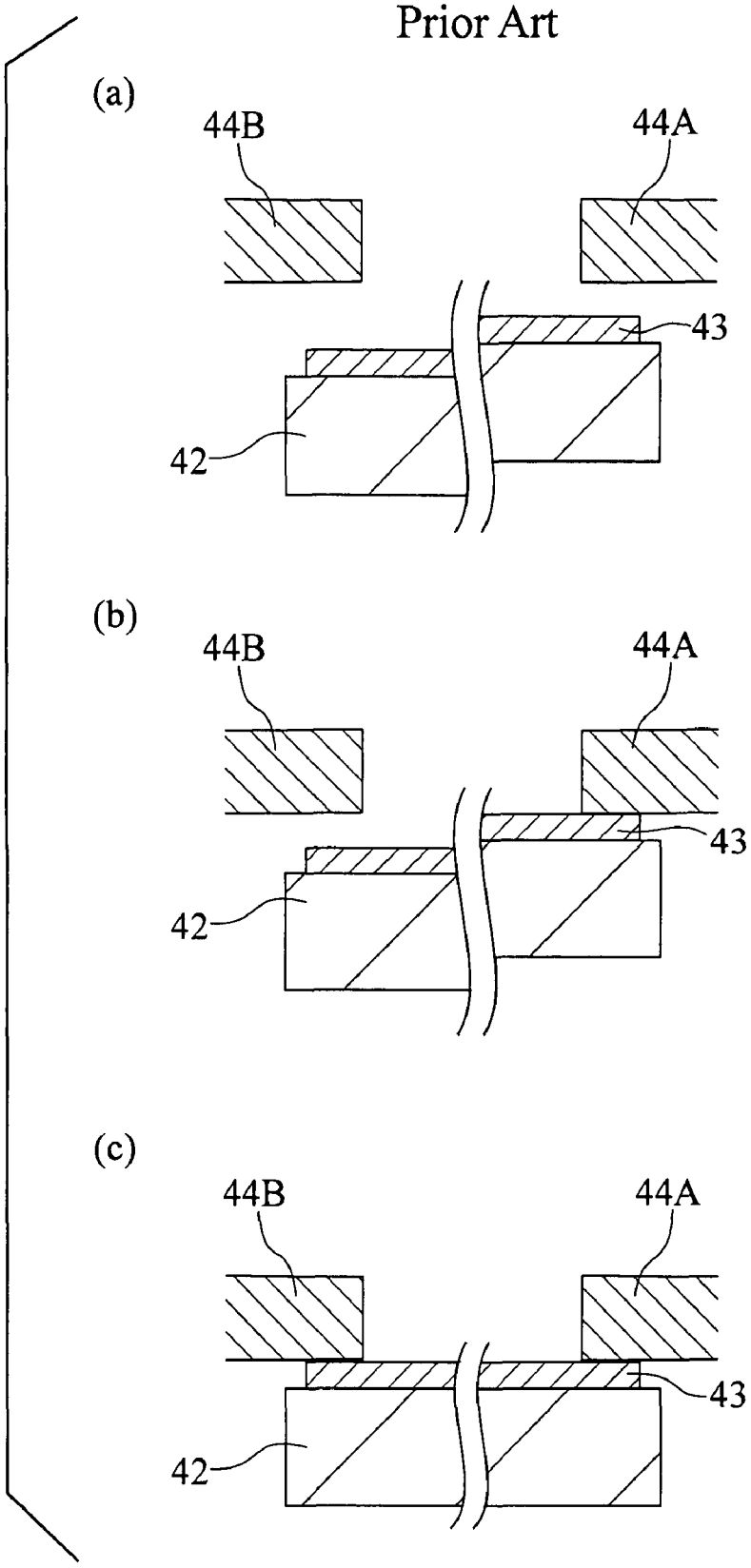
FIG.27 Prior Art
FIG. 27 illustrates a switching operation in the micro-switching device shown in FIG. 21.

FIG. 19 and FIG. 20 show a micro-switching device X3 according to a third embodiment of the present invention. FIG. 19 is a plan view of the micro-switching device X3, and FIG. 20 is a sectional view taken along lines XX-XX in FIG. 19.

The micro-switching device X3 includes a base substrate S1, a fixing member 11, a movable part 12, a contact portion 13, a pair of contact electrodes 14A, 14B, and a thermal driver portion 32. The micro-switching device X3 differs from the micro-switching device X1 in that it includes the thermal driver portion 32 instead of the driver electrodes 15, 16.

The thermal driver portion 32 includes thermal electrodes 32*a*, 32*b* which differ from each other in thermal expansion coefficient. The thermal electrode 32*a*, which is bonded directly to the movable part 12, has a larger thermal expansion coefficient than the thermal electrode 32*b*. The thermal electrode 32*a* is formed of e.g. Au. The thermal electrode 32*b* is formed of e.g. Al.

The drive mechanism in the micro-switching device according to the present invention may be provided by such a thermal driver portion 32 described above. As the thermal driver portion 32 operates, a switching operation is made on the present device.

The invention claimed is:

1. A micro-switching device comprising:

a fixing member;

a movable part including a first surface, a second surface opposite to the first surface, and a stationary end fixed to the fixing member;

a movable contact electrode including a first contact portion and a second contact portion formed on the first surface of the movable part, both the first contact portion and the second contact portion being spaced apart from the stationary end in a predetermined offset direction, the first contact portion and the second contact portion being spaced apart from each other in a direction intersecting the offset direction;

a first stationary contact electrode bonded to the fixing member and including a third contact portion facing the first contact portion of the movable contact electrode;

a second stationary contact electrode bonded to the fixing member and including a fourth contact portion facing the second contact portion of the movable contact electrode; and a drive mechanism including a driving force generation region on the first surface of the movable part;

wherein a distance between the first contact portion and the third contact portion is smaller than a distance between the second contact portion and the fourth contact portion, the driving force generation region having a center of gravity closer to the second contact portion than to the first contact portion.

2. The micro-switching device according to claim 1, wherein the movable contact electrode includes a first projection and a second projection, the first projection including the first contact portion, the second projection including the second contact portion.

3. The micro-switching device according to claim 2, wherein the first projection has a length of projection larger than a length of projection of the second projection.

4. The micro-switching device according to claim 2, wherein the first projection has a length of projection equal to a length of projection of the second projection.

5. The micro-switching device according to claim 1, wherein the first stationary contact electrode comprises a third projection, the third projection including the third contact portion, the second stationary contact electrode comprising a fourth projection, the fourth projection including the fourth contact portion.

6. The micro-switching device according to claim 5, wherein the third projection has a length of projection larger than a length of projection of the fourth projection.

7. The micro-switching device according to claim 5, wherein the third projection has a length of projection equal to a length of projection of the fourth projection.

8. The micro-switching device according to claim 1, wherein a distance between the first contact portion of the movable contact electrode and the third contact portion of the first stationary contact electrode is zero.

9. The micro-switching device according to claim 8, wherein the first contact portion and the third contact portion are bonded to each other.

10. The micro-switching device according to claim 1, wherein a distance between the stationary end of the movable part and the first contact portion of the movable contact electrode is different from a distance between the stationary end and the second contact portion.

11. The micro-switching device according to claim 1, wherein the movable part has a nonlinear structure.

12. The micro-switching device according to claim 1, wherein the center of gravity of the driving force generation region and the second contact portion are located on a same side with respect to a virtual straight line passing through a bisecting point of a length of the stationary end and a bisecting point of a distance between the first contact portion and the second contact portion.

13. A micro-switching device comprising:

a fixing member;

a movable part including a first surface, a second surface opposite to the first surface, and a stationary end fixed to the fixing member;

a movable contact electrode including a contact portion and a bonding portion formed on the first surface of the movable part, both the contact portion and the bonding portion being spaced apart from the stationary end in a predetermined offset direction, the contact portion and the bonding portion being spaced apart from each other in a direction intersecting the offset direction;

a first stationary contact electrode bonded to the fixing member and including a portion bonded to the bonding portion of the movable contact electrode;

a second stationary contact electrode bonded to the fixing member and including a portion facing the bonding portion of the movable contact electrode; and a drive mechanism including a driving force generation region on the first surface of the movable part;

wherein the driving force generation region has a center of gravity closer to the contact portion than to the bonding portion of the movable contact electrode.

14. The micro-switching device according to claim 13, wherein the center of gravity of the driving force generation region and the contact portion are located on a same side with respect to a virtual straight line passing through a bisecting point of a length of the stationary end and a bisecting point of a distance between the contact portion and the bonding portion.

15. The micro-switching device according to any one of claims 1-14, wherein the drive mechanism includes a movable driver electrode and a stationary driver electrode, the movable driver electrode being provided on the first surface of the movable part, the stationary driver electrode being bonded to the fixing member and including a portion facing the movable driver electrode.

16. The micro-switching device according to any one of claims 1-14, wherein the drive mechanism has a laminated structure provided by a first electrode film formed on the first surface of the movable part, a second electrode film and a piezoelectric film between the first electrode film and the second electrode film.

17. The micro-switching device according to any one of claims 1-14, wherein the drive mechanism has a laminated structure provided by a plurality of materials of different thermal expansion coefficients.

* * * * *